US009764813B1

(12) United States Patent
Zarembka et al.

(10) Patent No.: US 9,764,813 B1
(45) Date of Patent: Sep. 19, 2017

(54) TILLERS, TILLER SYSTEMS AND METHODS FOR CONTROLLING OUTBOARD MOTORS WITH TILLERS

(71) Applicant: Brunswick Corporation, Lake Forest, IL (US)

(72) Inventors: Jeffrey A. Zarembka, Plymouth, WI (US); Travis J. Vaninetti, Neenah, WI (US); Wayne M. Jaszewski, Jackson, WI (US); Jolayne K. Ingebritson, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 15/273,052

(22) Filed: Sep. 22, 2016

Related U.S. Application Data

(63) Continuation-in-part of application No. 15/254,528, filed on Sep. 1, 2016, which is a continuation-in-part of application No. 15/236,534, filed on Aug. 15, 2016.

(51) Int. Cl.
*B63H 20/12* (2006.01)
*B63H 21/21* (2006.01)

(52) U.S. Cl.
CPC ..... *B63H 21/213* (2013.01); *B63H 20/12* (2013.01)

(58) Field of Classification Search
CPC ..... B63H 21/21; B63H 20/007; B63H 20/08; B63H 20/12; B63H 2021/21
USPC ..... 440/84, 85, 86, 87
See application file for complete search history.

(56) References Cited

U.S. PATENT DOCUMENTS

| | | | | |
|---|---|---|---|---|
| 3,636,911 | A * | 1/1972 | Piazza | B63H 21/213 440/87 |
| 4,496,326 | A | 1/1985 | Boda | |
| 4,878,468 | A | 11/1989 | Boda et al. | |
| 5,340,342 | A | 8/1994 | Boda et al. | |
| 5,632,657 | A | 5/1997 | Henderson | |
| 6,264,516 | B1 | 7/2001 | McEathron et al. | |
| 6,406,342 | B1 | 6/2002 | Walczak et al. | |
| 7,090,551 | B1 | 8/2006 | Lokken et al. | |
| D611,501 | S | 3/2010 | Vignau et al. | |
| D611,502 | S | 3/2010 | Vignau et al. | |
| 7,677,938 | B2 | 3/2010 | Wiatrowski et al. | |
| 7,704,110 | B2 | 4/2010 | Wiatrowski et al. | |
| 7,895,959 | B1 | 3/2011 | Angel et al. | |
| 8,257,122 | B1 | 9/2012 | Holley | |

* cited by examiner

*Primary Examiner* — Lars A Olson
(74) *Attorney, Agent, or Firm* — Andrus Intellectual Property Law, LLP

(57) ABSTRACT

A tiller is for an outboard motor. The tiller comprises a tiller body that is elongated along a tiller axis between a fixed end and a free end. A throttle grip is disposed on the free end. The throttle grip is rotatable through a first (left handed) range of motion from an idle position in which the outboard motor is controlled at idle speed to first (left handed) wide open throttle position in which the outboard motor is controlled at wide open throttle speed and alternately through a second (right handed) range of motion from the idle position to a second (right handed) wide open throttle position in which the outboard motor is controlled at wide open throttle speed.

20 Claims, 26 Drawing Sheets

TILLERS, TILLER SYSTEMS AND METHODS FOR CONTROLLING OUTBOARD MOTORS WITH TILLERS

CROSS-REFERENCE TO RELATED APPLICATIONS

This application is a Continuation-In-Part of and claims the benefit of and priority to U.S. Patent Application Serial No., filed Ser. No. 15/254,528, filed Sep. 1, 2016, which is a Continuation-In-Part of U.S. patent application Ser. No. 15/236,534, filed Aug. 15, 2016, both of which are incorporated herein by reference in entirety.

FIELD

The present disclosure relates to outboard motors, and particularly to tillers for outboard motors.

BACKGROUND

The following U.S. Patents are incorporated herein by reference, in entirety:

U.S. Pat. No. 8,257,122 discloses a multi-function throttle shaft that combines motor speed-control and motor direction-control in one tiller handle. Co-functionally, the throttle shaft is rotated clockwise/counterclockwise to control motor speed while intuitively allowing the user to push the throttle in for reverse direction and pull the throttle out for forward direction or vise-versa, based on whether the trolling motor is mounted on the transom or bow of a boat. In either case, the handle is always moved in the same direction that the operator wants the boat to travel.

U.S. Pat. No. 7,895,959 discloses advanced steering system designs for marine vessels which incorporate non-linear tiller arms for rudder control, designed for creating different turning radii for discrete rudders. Differential tillers are utilized to create distinct angular displacement of the separate rudders in turning maneuvers, which enhance control and maneuverability of the marine vessels.

U.S. Pat. No. 7,090,551 discloses a tiller arm provided with a lock mechanism that retains the tiller arm in an upwardly extending position relative to an outboard motor when the tiller arm is rotated about a first axis and the lock mechanism is placed in a first of two positions. Contact between an extension portion of the lock mechanism and the discontinuity of the arm prevents the arm from rotating downwardly out of its upward position.

U.S. Pat. No. 6,406,342 discloses a control handle for a tiller of an outboard motor provided with a rotatable handle grip portion that includes an end surface which supports a plurality of push buttons that the operator of a marine vessel can depress to actuate certain control mechanisms and devices associated with the outboard motor. These push buttons include trim up and trim down along with gear selector push buttons.

U.S. Pat. No. 6,264,516 discloses an outboard motor provided with a tiller handle that enables an operator to control the transmission gear selection and the throttle setting by rotating the hand grip of the tiller handle. It also comprises a means for allowing the operator to disengage the gear selecting mechanism from the throttle mechanism. This allows the operator to manipulate the throttle setting without having to change the gear setting from neutral position.

U.S. Pat. No. 5,632,657 discloses a movable handle mounted to a trolling motor head. The handle is pivotally adjustable upwardly and downwardly to suit different positions of a fisherman while controlling the trolling motor. The handle spans across the motor head and acts as a tiller for pivoting the motor about its axis. The resistance to positional changes is adjustable and protective features are provided to prevent damage to the adjustment mechanism in the event of tightening. The handle incorporates therein various controls for the motor head.

U.S. Pat. No. 5,340,342 discloses a tiller handle provided for use with one or more push-pull cables inter-connected to the shift and the throttle mechanisms of an outboard marine engine to control the shift and the throttle operations of the engine. The tiller handle includes a rotatable cam member with one or more cam tracks located on its outer surface. Each push-pull cable is maintained within a distinct cam track such that rotating the rotatable cam member actuates the push-pull cables thereby controlling the operation of the shift and the throttle mechanisms of the engine.

U.S. Pat. No. 4,878,468 discloses an outboard marine motor housed by a cowl assembly having an upper cowl section and a lower cowl section. The cowl assembly includes various features for improving the structural integrity of the cowl assembly and for providing a water-resistant seal at the joint between the cowl sections and at various points of entry of cables and other mechanical devices. A cut-out portion in the side of the lower cowl assembly is adapted to receive various cables and shift levers for different configurations of outboard marine motors, e.g. a manual tiller-operated motor including shift controls, a manual tiller-operated motor having a separate shift lever, and a remote-control motor having throttle and shift cables leading into the engine cavity. A sealing mechanism is provided at the cut-out portion of the lower cowl assembly, to provide a water-resistant seal at the points of entry of the cables or shift lever through the lower cowl section.

U.S. Pat. No. 4,496,326 discloses a steering system for a marine drive having a propulsion unit pivotally mounted on the transom of a watercraft and a tiller. The steering system includes a steering vane rotatably mounted on the propulsion unit for generating hydrodynamic forces to pivot or assist in pivoting the propulsion unit and to counteract propeller torque. An adjustable mount interposed between the propulsion unit and the tiller mounts the tiller for movement relative to the propulsion unit. A cable connects the tiller to the steering vane so that movement of the tiller with respect to the propulsion unit rotates the vane. The adjustable mount includes mutually engageable elements that can lock the tiller against movement relative to the propulsion unit so that the tiller may be used to directly steer the propulsion unit, if desired. For this purpose, the elements of the adjustable mount may be engaged by applying a downward pressure on the tiller.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

A tiller is for an outboard motor. The tiller comprises a tiller body that is elongated along a tiller axis between a fixed end and a free end. A throttle grip is on the free end. The throttle grip is rotatable through a first (left-handed) range of motion from an idle position in which the outboard motor is controlled at idle speed to first (left-handed) wide open throttle position in which the outboard motor is controlled at wide open throttle speed, and alternately through a second (right-handed) range of motion from the idle position to a second (right-handed) wide open throttle position in which the outboard motor is controlled at the wide open throttle speed.

In certain examples, a throttle linkage is coupled to the throttle grip. The throttle linkage is configured to control a throttle of the outboard motor based upon manual rotation of the throttle handle. A rotation direction switching mechanism is movable into a first (left-handed) position wherein movement of the throttle grip in the first range of motion controls the throttle mechanism and a second (right-handed) position wherein movement of the throttle grip in the second range of motion controls the throttle linkage. Corresponding methods of operation are also herein disclosed.

BRIEF DESCRIPTION OF THE DRAWINGS

The present disclosure is described with reference to the following Figures. The same numbers are used throughout the Figures to reference like features and like components.

DETAILED DESCRIPTION OF THE DRAWINGS

Figure 1:
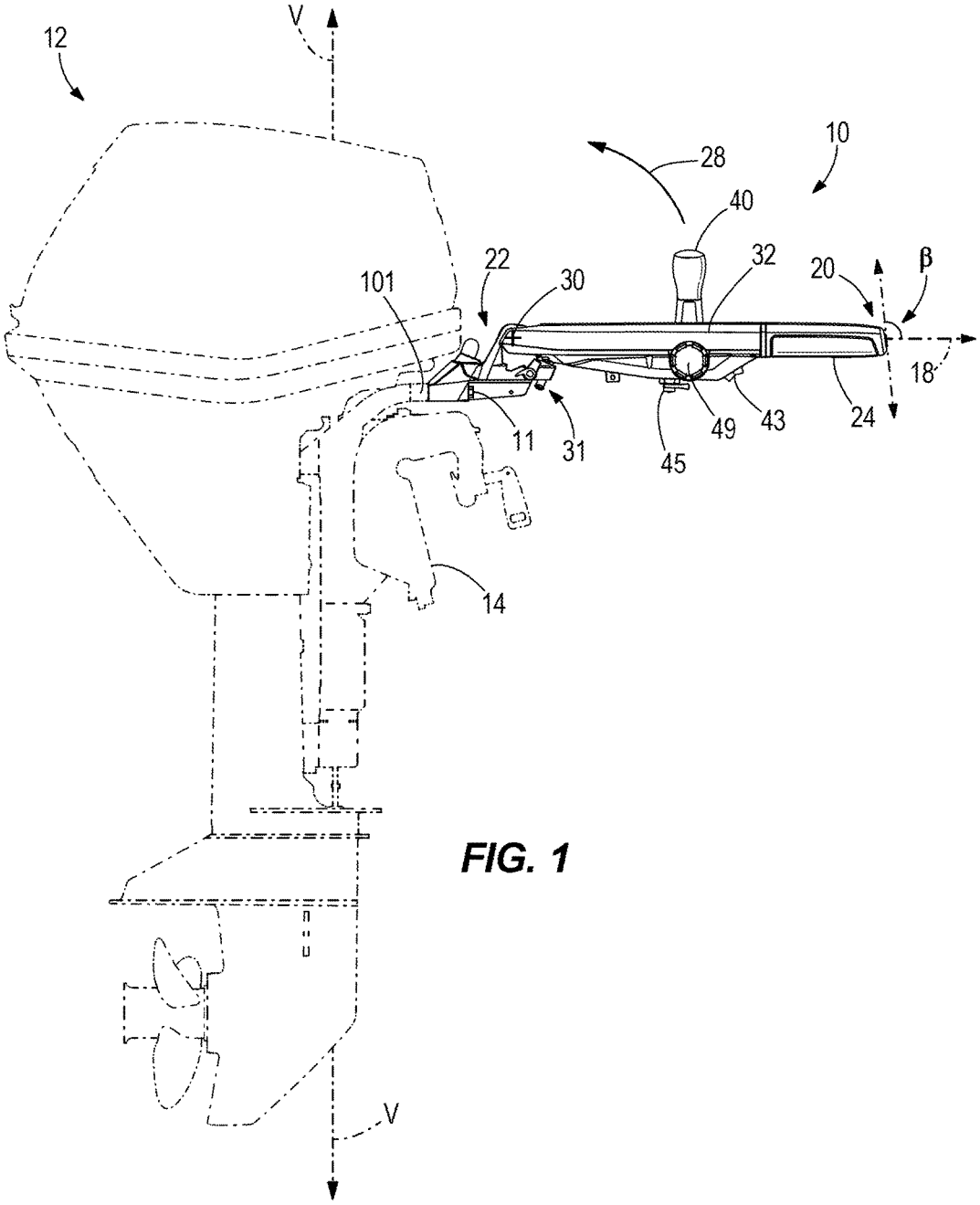
FIG. 1 is a side view of an outboard motor and a tiller.

FIG. 1 depicts a tiller 10 for use with an outboard motor 12. The tiller 10 is illustrated in solid line format and the outboard motor 12 is illustrated in dash-and-dot line format. The configuration of outboard motor 12 is exemplary and can vary from what is shown. In the illustrated example, the outboard motor 12 is configured for attachment to the transom of a marine vessel via a transom bracket 14 such that the outboard motor 12 is steerable about a vertical steering axis V, as is conventional.

Figure 2:
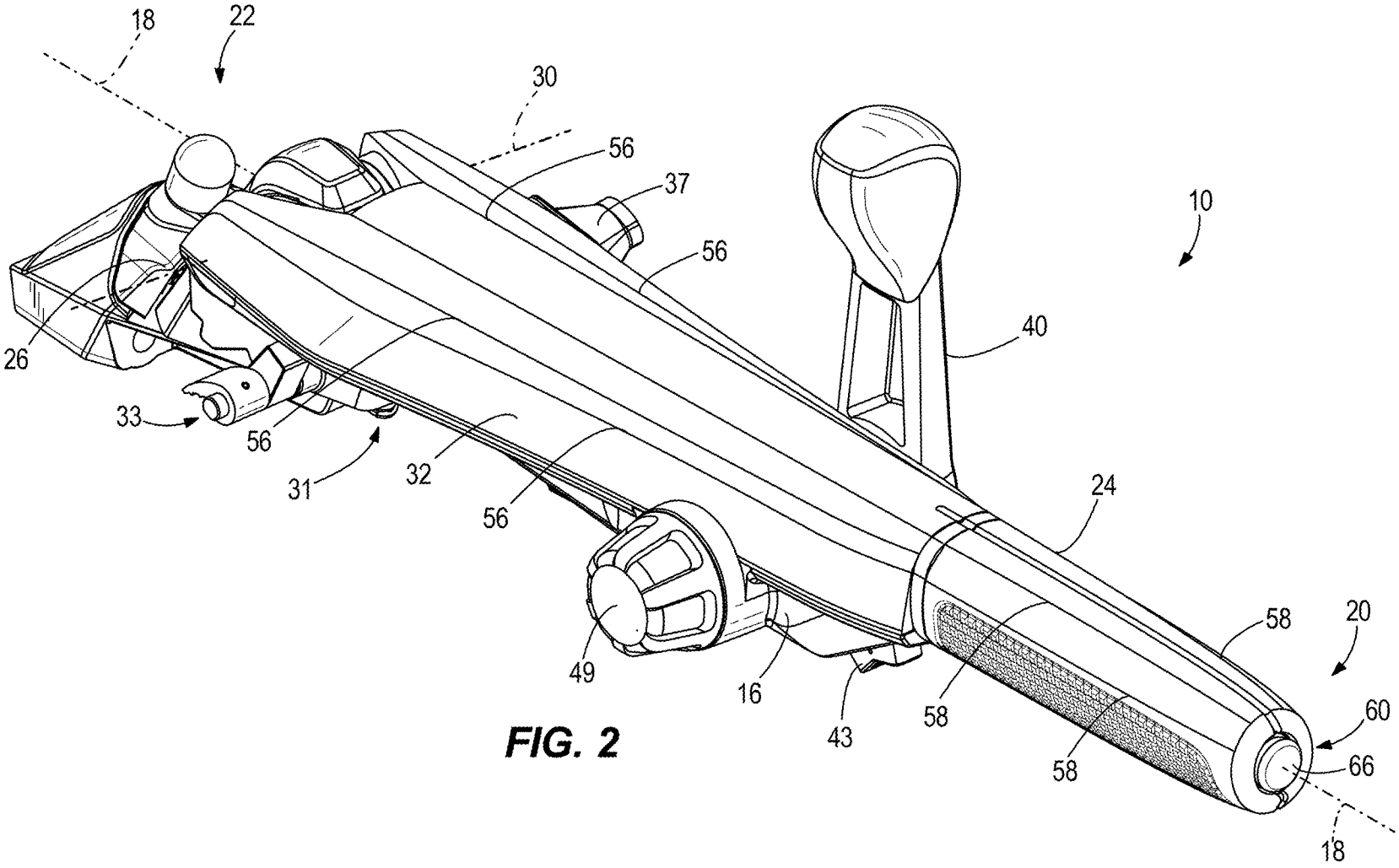
FIG. 2 is a perspective view of the tiller in a horizontal position.
Figure 3:
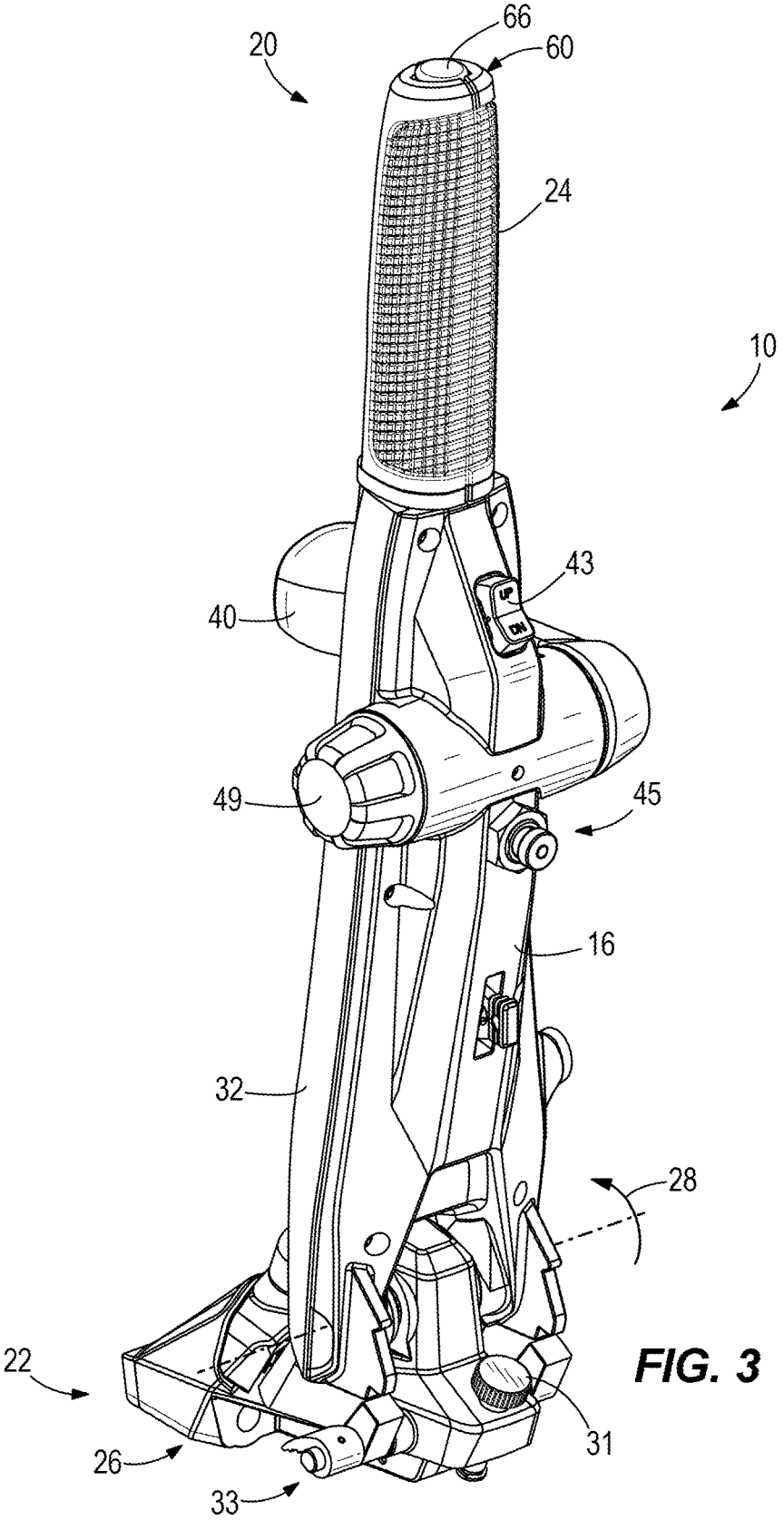
FIG. 3 is a perspective view of the tiller in a vertical position.

Referring to FIGS. 2-5, the tiller 10 has a tiller chassis 16 that extends in an axial direction along a tiller axis 18. The tiller chassis 16 has a first axial end 20 and an axially opposite, second axial end 22. A rotatable throttle grip 24 is supported on the first axial end 20. An adjustable mount 26 is located at the second axial end 22, and is configured to facilitate pivoting of the tiller 10 through a range of motion 28 (FIGS. 1 and 3) including at least into and between a horizontal position (FIG. 2) wherein the tiller chassis 16 extends horizontally and a vertical position (FIG. 3) wherein the tiller chassis 16 extends vertically. In certain examples, the tiller chassis 16 is made of metal. The type and configuration of adjustable mount 26 can vary from what is shown, and for example can include any one or a combination of adjustable mount embodiments, several of which are detailed herein below. As is conventional, the adjustable mount 26 allows for pivoting of the tiller 10 through the range of motion 28 about a horizontal pivot axis 30 (FIG. 2). An optional adjustment bolt 31 and ratchet lever 33 are located at the adjustable mount 26 and facilitate positional and pivoting movement, as is conventional.

Figure 4:
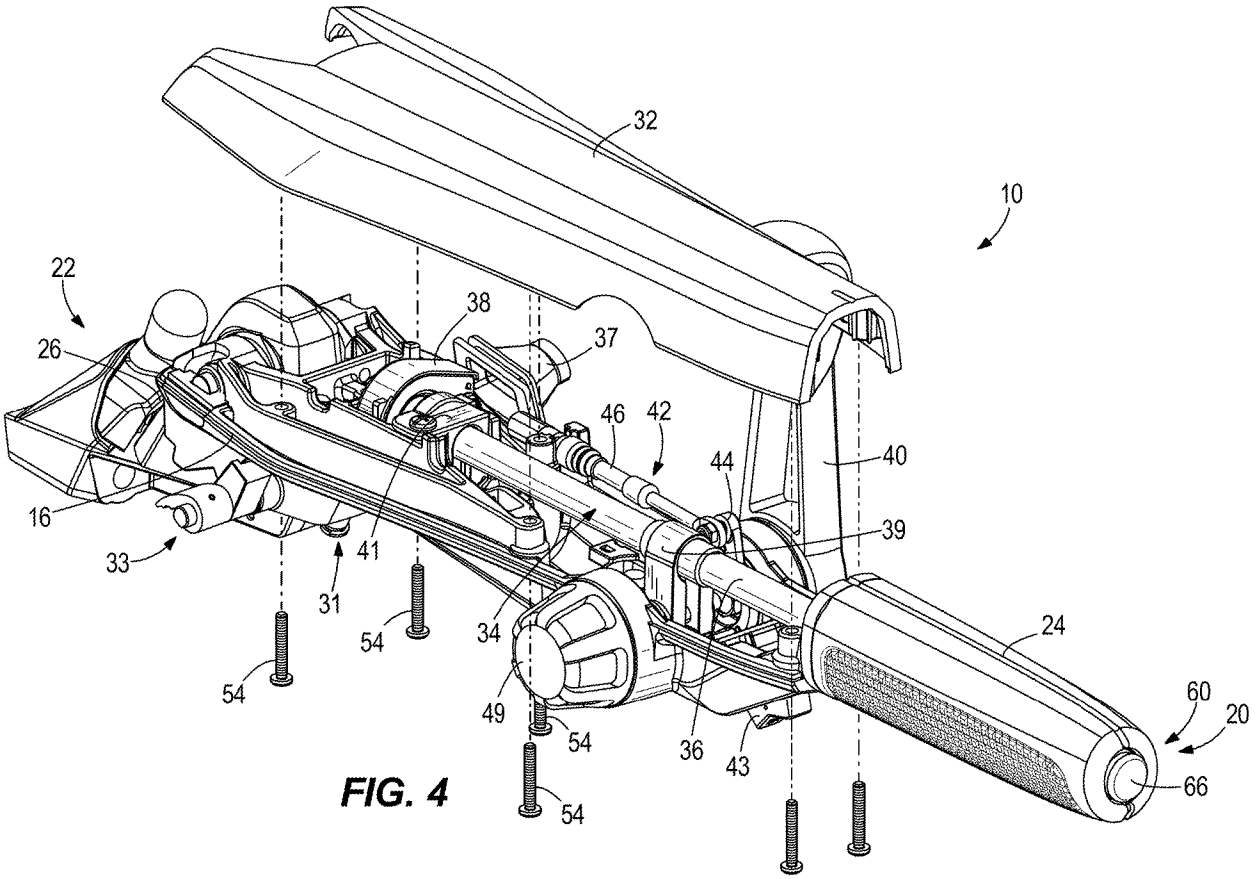
FIG. 4 is a perspective view of the tiller having the top cover removed.
Figure 5:
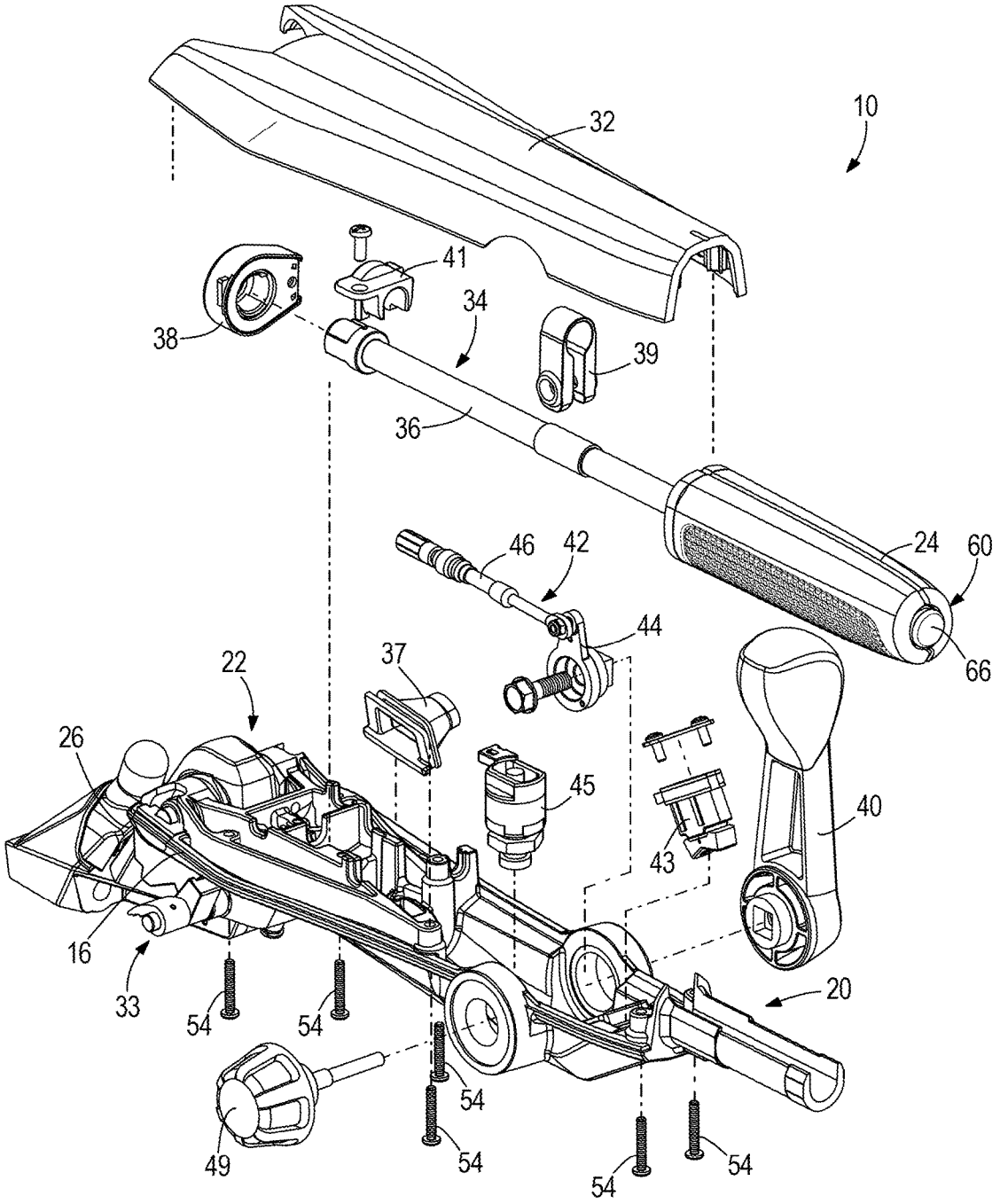
FIG. 5 is an exploded view of the tiller.

A top cover 32 is disposed on top of the tiller chassis 16. The top cover 32 and tiller chassis 16 together define an interior of the tiller 10. The top cover 32 is particularly located on top of the tiller chassis 16 when the tiller 10 is in the horizontal position (FIG. 2). Advantageously, the top cover 32 is removable from the tiller chassis 16 when the tiller 10 is in the horizontal position (FIG. 2). Thus, as illustrated in FIG. 4, removal of the top cover 32 provides access to the interior from above the tiller 10 when the tiller 10 is in the horizontal position (FIG. 2). This advantageously provides access to the interior in a more ergonomic and less awkward position compared to the prior art. In certain examples, the top cover 32 is made of plastic. Referring to FIG. 5, the top cover 32 is coupled to the tiller chassis 16 by removable fasteners 54. Removal of the fasteners 54 allows removable of the top cover 32 from the tiller chassis 16. In other examples, the top cover 32 is removably fastened to the tiller chassis 16 by a snap-fit engagement or other non-permanent connection. Advantageously the fasteners 54 are inserted from below the tiller 10 in the horizontal position. Thus the fasteners 54 remain hidden from view in the horizontal position, providing an aesthetically pleasing appearance.

Referring to FIG. 5, the tiller 10 has a throttle linkage 34 that links the rotatable throttle grip 24 to a throttle (not shown) on the outboard motor 12, as is conventional. The throttle linkage 34 includes a throttle shaft 36 that is disposed in the interior of the tiller 10 such that the tiller chassis 16 is located vertically beneath and supports the throttle shaft 36 when the tiller 10 is in the horizontal position (FIG. 2). The throttle shaft 36 thus extends parallel to the tiller axis 18 and is held in place by a mounting sleeve 39 and a hold-down bracket 41. Rotation of the rotatable throttle grip 24 causes rotation of the throttle shaft 36. A rotatable locking knob 49 is coupled to the mounting sleeve 39. Rotation of the locking knob 49 in one direction squeezes the mounting sleeve 39 to lock the position of the throttle shaft 36 and rotatable throttle grip 24 thus facilitating hands-free operation. Opposite rotation of the locking knob 49 relaxes the mounting sleeve 39 and thus allows manual rotation of the rotatable throttle grip 24 and associated throttle shaft 36.

The throttle linkage 34 further includes a throttle pulley 38, which is also disposed in the interior of the tiller 10 such that the tiller chassis 16 is located vertically beneath and supports the throttle pulley 38 when the tiller 10 is in the horizontal position (FIG. 2). The throttle pulley 38 is configured for connection to throttle cables (not shown), which extend through a grommet 37 in the tiller chassis 16 to a corresponding pulley on the throttle of the outboard motor (not shown). Rotation of the rotatable throttle grip 24 thus causes rotation of the throttle shaft 36, which rotates the throttle pulley 38, causing corresponding pulling motion on the noted throttle cables and corresponding pulley on the throttle of the outboard motor 12.

A manual shift lever 40 is coupled to the tiller chassis 16. A shift linkage 42 links the manual shift lever 40 to a transmission (not shown) on the outboard motor 12. The shift linkage 42 includes a shift link 44 that is disposed in the interior of the tiller 10 such that the tiller chassis 16 is located vertically beneath and supports the shift link 44 when the tiller 10 is in the horizontal position (FIG. 2). Manual shifting of the shift lever 40 causes corresponding rotation of the shift link 44, which translates a push cable 46. Translation of the push cable 46 causes corresponding shifting action in the transmission of the outboard motor 12, as is conventional.

Optional tiller components can be supported by the tiller chassis 16, including a manual trim switch 43 and associated circuitry, as well as a kill switch 45 and associated circuitry for shutting off the outboard motor in an emergency. The kill switch 45 is actuated by a conventional removable lanyard (not shown). These components are conventional and thus are not further described herein.

The present disclosure thus provides a tiller 10 that provides improved access for maintenance. The tiller chassis 16 is advantageously positioned on the underside of the tiller 10 in the horizontal position and underneath and supporting the internal components of the tiller 10. The easily removable top cover 32 protects the internal components of the tiller 10 and provides an aesthetically pleasing design. In use, the user simply removes the top cover 32 and can easily access the components of the tiller 10 in the horizontal position.

Figure 6:
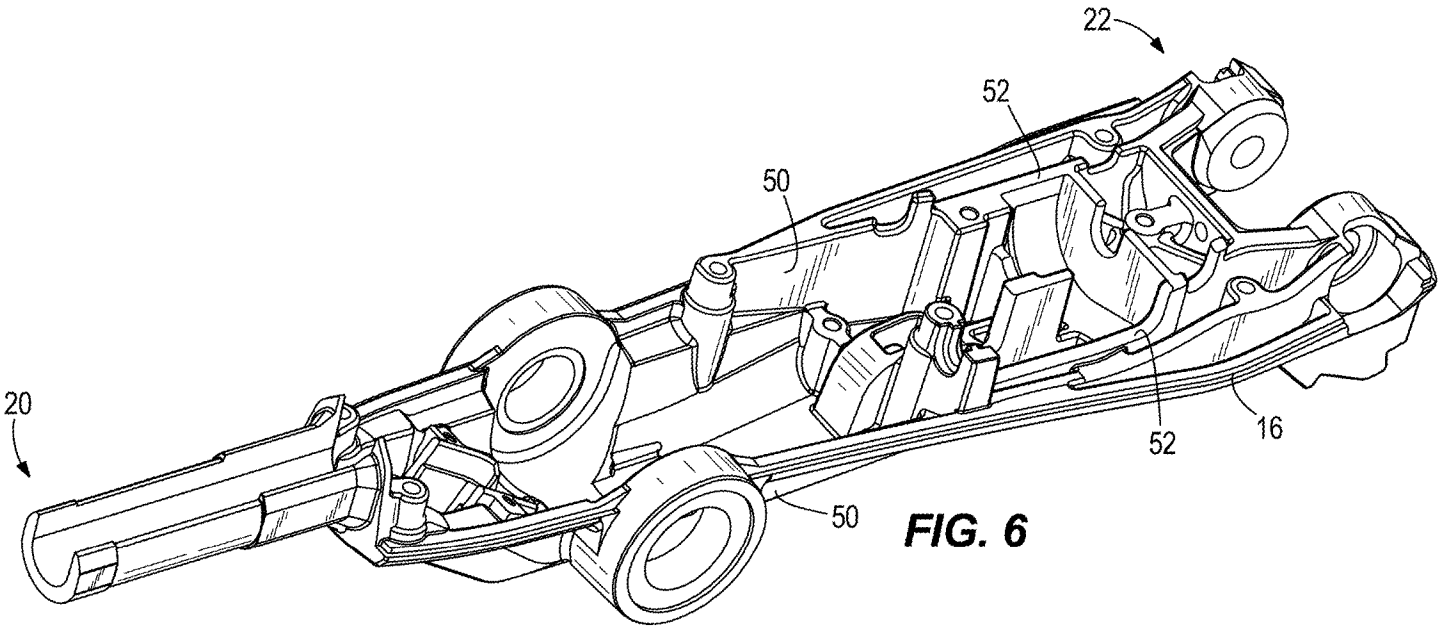
FIG. 6 is a perspective view of a tiller chassis.
Figure 7:
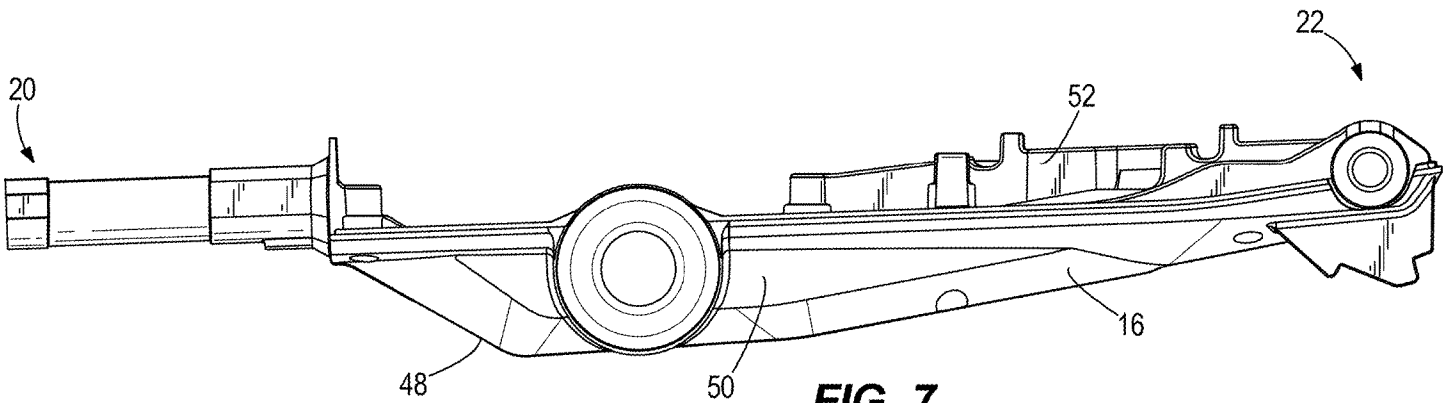
FIG. 7 is a side view of the tiller chassis.
Figure 8:
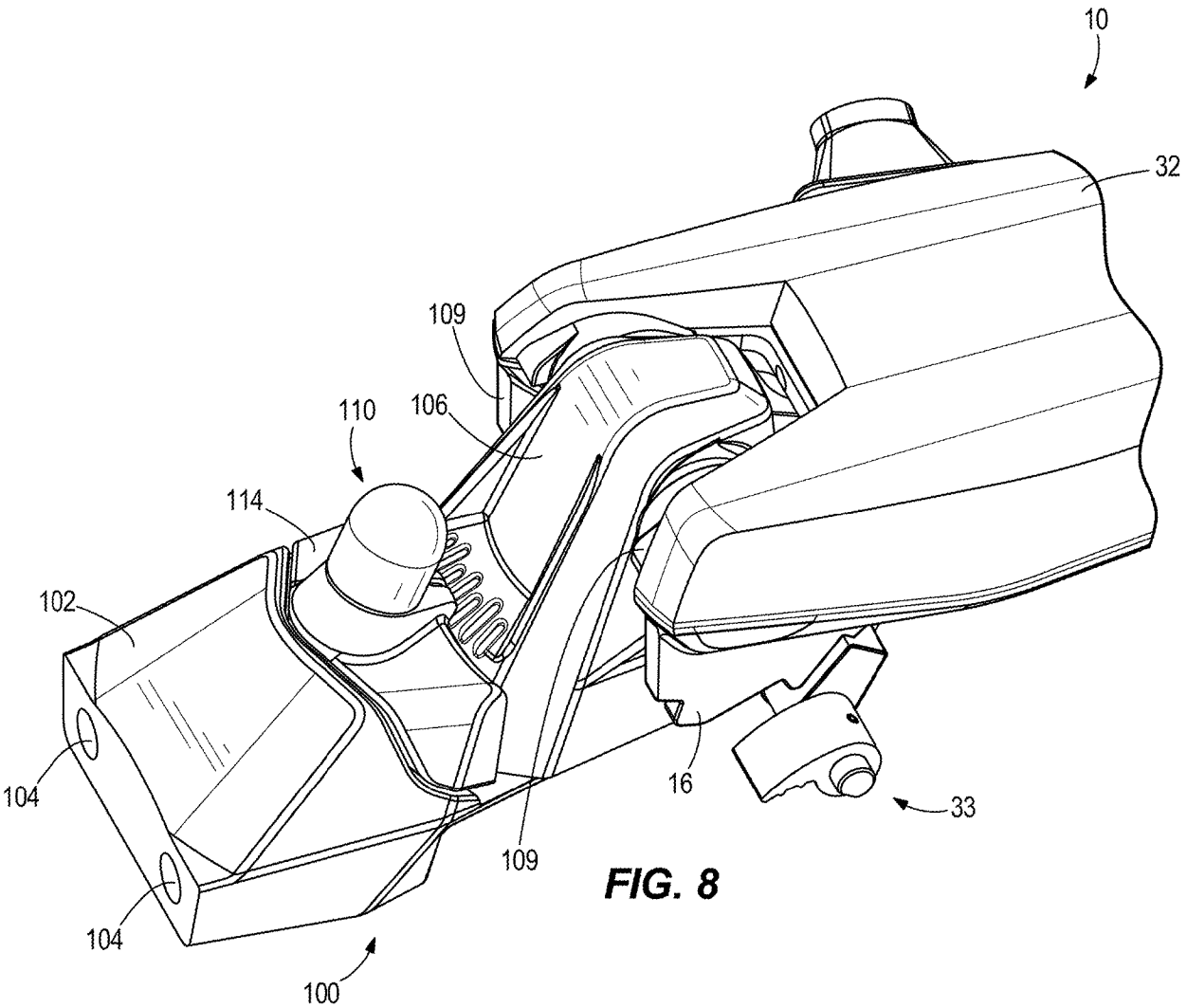
FIG. 8 is a perspective view of a first embodiment of an adjustable mount for the tiller.

As shown in FIGS. 6 and 7, the tiller chassis 16 includes a bottom wall 48 and opposing side walls 50 that extend vertically upwardly and on opposite sides of the bottom wall 48 when the tiller 10 in is the horizontal position (FIG. 2). A plurality of supporting ribs 52 is formed along the bottom wall 48. The supporting ribs 52 are located closer to the second axial end 22 and the first axial end 20. The supporting ribs 52 are advantageously configured to absorb reaction forces in the tiller chassis 16 due to a downward force applied to the first axial end 20 to the tiller 10, for example by a user placing their hand on the rotatable throttle grip 24 and pushing downwardly thereon. The supporting ribs 52 axially extend with respect to the tiller chassis and extend vertically higher than the side walls 50 when the tiller 10 is in the horizontal position, see FIGS. 2 and 7.

Referring to FIG. 2 a first set of axial alignment ribs 56 axially extends along the top cover 32. A second set of axial alignment ribs 58 extends along the rotatable throttle grip 24. The first and second sets of axial alignment ribs 56, 58 are in alignment when the rotatable throttle grip 24 is located in an idle position, see FIG. 2. In contrast, the first and second sets of axial alignments ribs 56, 58 move out of alignment with each other when the rotatable throttle grip 24 is located out of the idle position shown in FIG. 2. Advantageously, this allows the operator to see and feel the position of the throttle grip 24 with respect to the top cover 32 and tiller chassis 16.

Referring to FIGS. 1 and 2, the rotatable throttle grip 24 also has a beveled end surface 60 that is set at an angle β with respect to vertical so that the beveled end surface 60 is visible from vertically above the tiller 10. The angle β provides increased visibility and easier access to a kill switch 66 located at the beveled end surface 60 when the tiller 10 is in the horizontal position.

FIGS. 8-13 depict a first embodiment of an adjustable mount 100 for attaching the tiller chassis 16 of the tiller 10 to the outboard motor 12. As further explained herein below, the adjustable mount 100 advantageously allows the operator to manually reposition the tiller 10 about a vertical axis 113 (see FIGS. 11-13) with respect to the outboard motor 12, so that the tiller 10 can be fixed at any one of a plurality of fixed angles with respect to the outboard motor 12, including a neutral position (see FIG. 11) and a variety of different left-handed and right-handed tiller positions (e.g., compare FIGS. 12 and 13).

The adjustable mount 100 includes a base bracket 102 configured to be rotationally fixed with respect to the outboard motor 12. The manner in which the base bracket 102 is rotationally fixed to the outboard motor 12 can vary from what is shown. In the illustrated example, the base bracket 102 is fastened to a steering arm 101 (see FIG. 1) on the outboard motor 12. The manner in which the base bracket 102 is fixed to the steering arm 101 can also vary from what is shown. In the illustrated example, the base bracket 102 is fixed to the steering arm via fasteners 11 (see FIG. 1) that extend through holes 104 (see FIG. 8) in the base bracket 102 and corresponding holes in the steering arm. In the illustrated example, the fasteners 11 include threaded bolts.

The adjustable mount 100 also includes a chassis bracket 106 configured to couple the tiller chassis 16 to the base bracket 102 such that the tiller chassis 16 can be selectively rotated with respect to the base bracket 102 and associated outboard motor 12 about a vertical axis when the tiller 10 is in the horizontal position. The manner in which the chassis bracket 106 is coupled to the tiller chassis 16 can vary from what is shown. In the illustrated example, the chassis bracket 106 has a lateral through-bore 117 (FIGS. 11-13) for supporting a tilt shaft (not shown) having opposite ends connected to opposing arms 109 of the tiller chassis 16. The tilt shaft extends along the noted horizontal pivot axis 30, which is described herein above with respect to FIG. 2. The tiller chassis 16 is pivotable with respect to the chassis bracket 106 about the noted horizontal pivot axis 30, as illustrated at 28 in FIG. 2, via its connection to the tilt shaft. The chassis bracket 106 is also configured to support the optional components including the adjustment bolt 31 and ratchet lever 33, which facilitate the positional and pivoting movement of the tiller 10, as is conventional and described herein above.

The adjustable mount 100 further includes a locking arrangement (generally referred to at the arrow in FIG. 8), which is movable into and between a locked position (see e.g., FIG. 8 and FIGS. 11-13) wherein the chassis bracket 106 and associated tiller chassis 16 remain rotationally fixed with respect to the base bracket 102 and associated outboard motor 12, and an unlocked position (see e.g., FIG. 9) wherein the chassis bracket 106 and tiller chassis 16 are freely movable (e.g., rotatable) with respect to the base bracket 102 and outboard motor 12 about the vertical axis 113. As explained further herein reference to FIGS. 11-13, the locked position can be any one of a plurality of locked positions into and between which the locking arrangement 110 is movable. In each of the locked positions, the chassis bracket 106 and associated tiller chassis 16 extends at a different respective fixed angle with respect to the base bracket 102, thus facilitating the noted operator selection between various left-handed and right-handed angular positions.

In the unlocked position, the chassis bracket 106 is removed from the base bracket 102 and/or manually pivotable with respect to the base bracket 102 about a vertical pivot shaft 124. The construction of the vertical pivot shaft 124 can vary from what is shown. In the illustrated example the vertical pivot shaft 124 includes a fastener (e.g., threaded bolt) that extends through a hole 123 in the base bracket 102 and mates with a corresponding threaded hole 125 (FIG. 10) in the chassis bracket 106.

The locking arrangement 110 includes a locking fastener 112, which couples the chassis bracket 106 to the base bracket 102 in each of the various locked positions. In the illustrated example, the locking fastener 112 is a bolt and a nut; however other types of locking fasteners could be used. Removal of the locking fastener 112 facilitates unlocking of the chassis bracket 106 and base bracket 102, as described further herein below.

The locking arrangement 110 also includes a toe clamp 114, which in the locked position is locked to the base bracket 102 and the chassis bracket 106 by the locking fastener 112. More specifically, as shown by dashed and dotted line in FIGS. 9 and 10, the locking fastener 112 attaches the toe clamp 114 to the base bracket 102 via engagement with a through-hole 111 in the toe clamp 114 and a hole 115 in the base bracket 102. In the unlocked position (FIG. 9), the locking fastener 112 is unthreaded from the threaded hole 115 and the locking fastener 112 and toe clamp 114 are removed from the base bracket 102 and chassis bracket 106.

Figure 9:
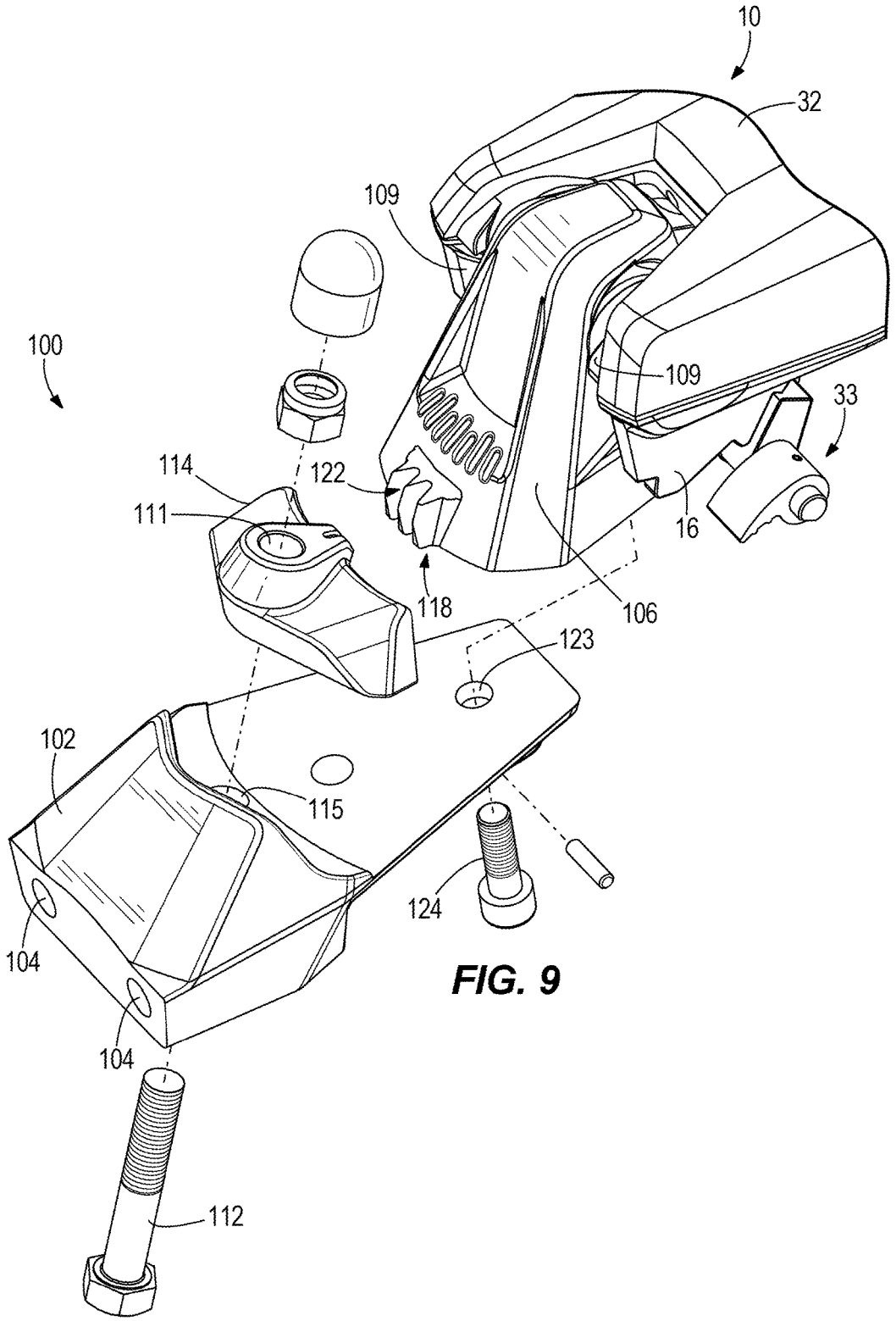
FIG. 9 is an exploded view of the adjustable mount of FIG. 8.
Figure 10:
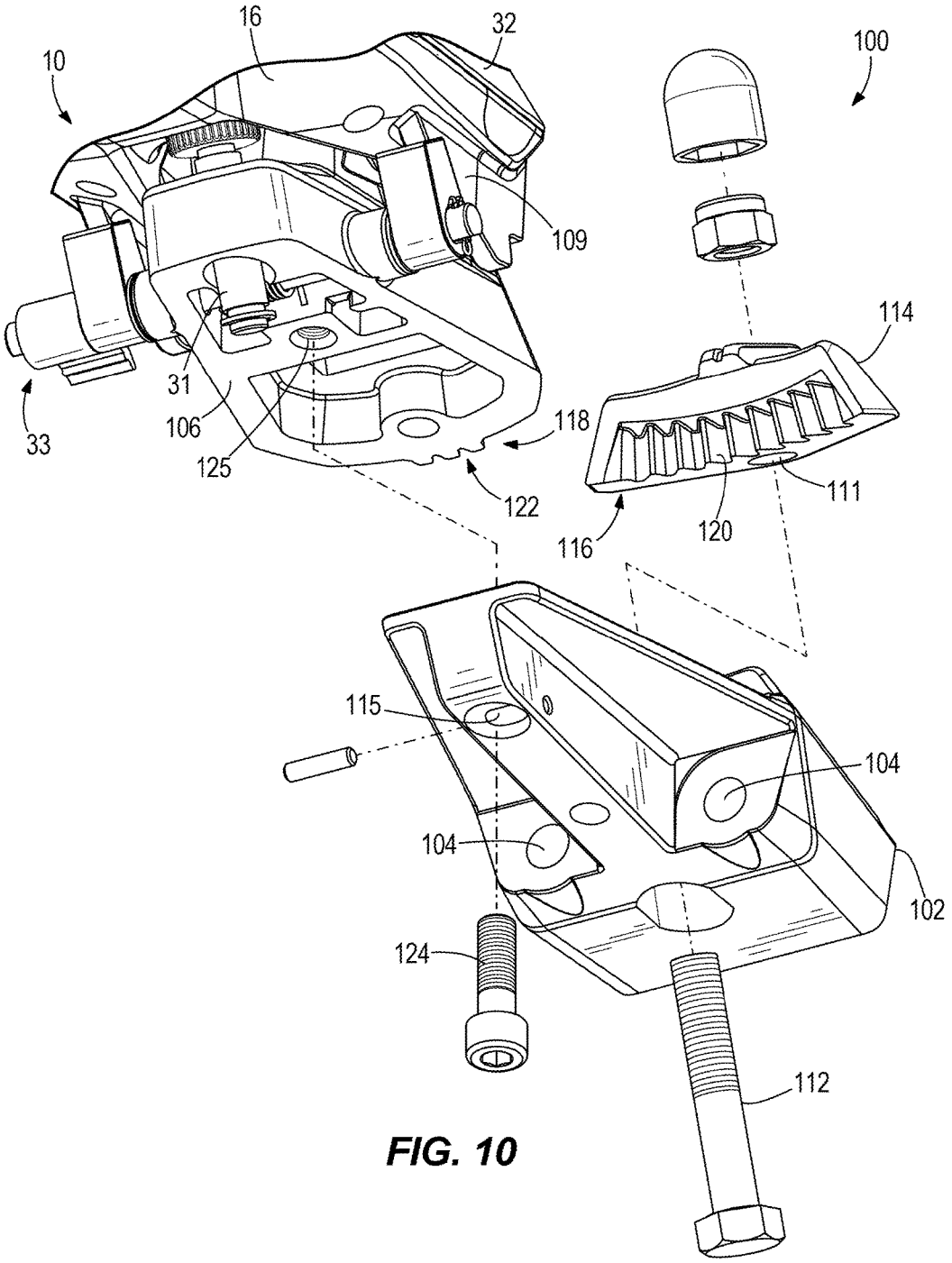
FIG. 10 is another exploded view of the adjustable mount of FIG. 8.
Figure 13:
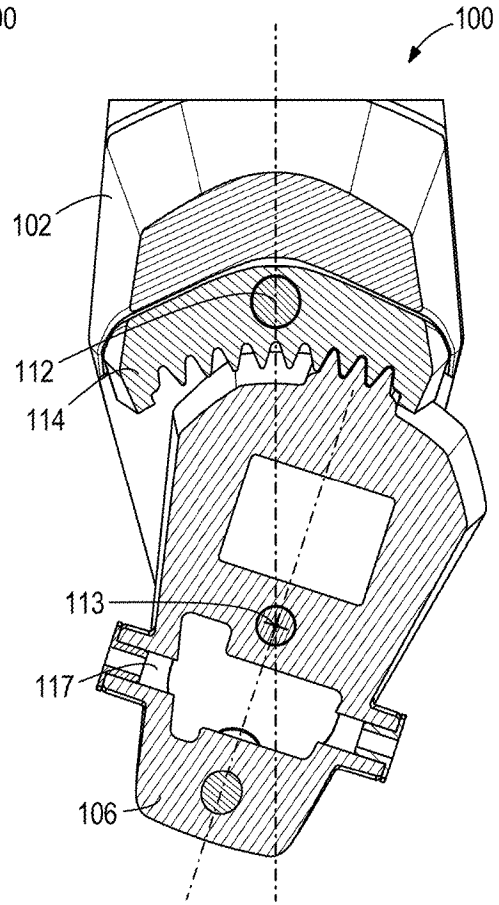
FIGS. 11-13 are sectional views showing the adjustable mount of FIG. 8 in various orientations.
Figure 12:
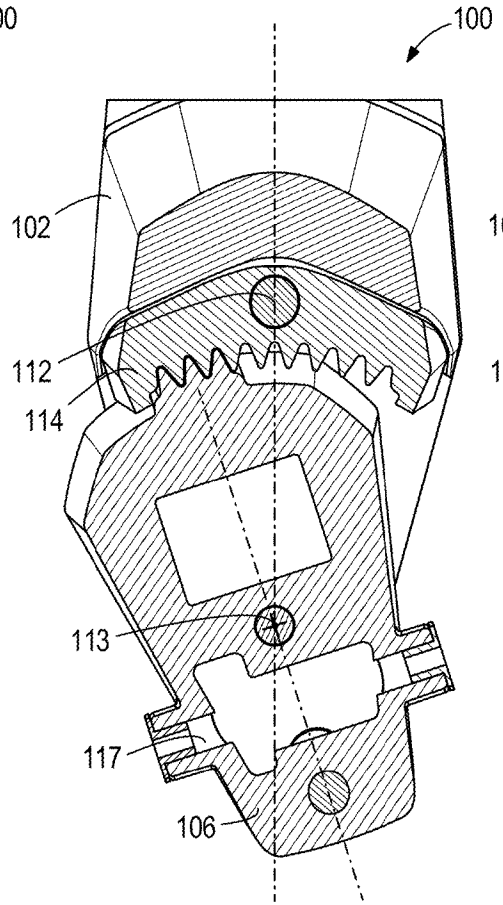
Figure 11:
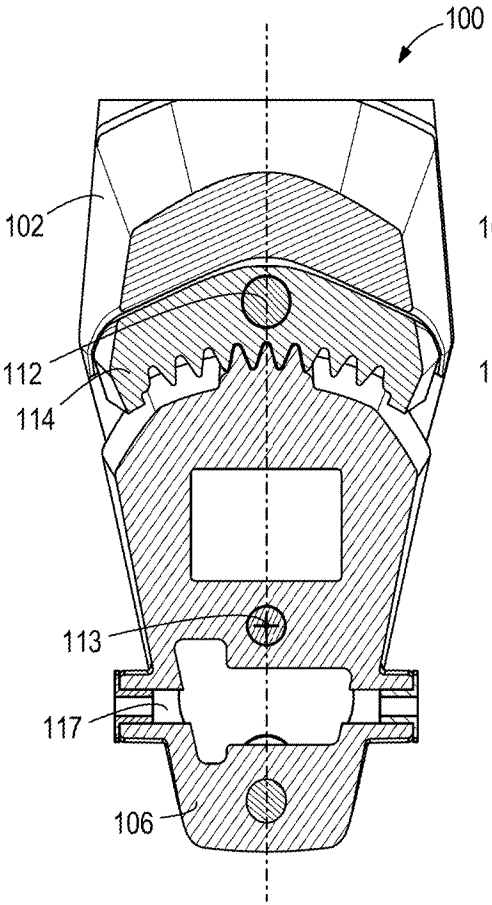

Referring to FIGS. 9 and 10, the locking arrangement 110 also includes a male-female connector having a male portion 116 and a female portion 118, which are configured to mate together in the locked position and disengage from each other in the unlocked position. More specifically, the male-female connector is configured such that when the locking fastener 112 attaches the toe clamp 114 to the base bracket 102, the chassis bracket 106 is engaged by and remains rotationally fixed with respect to the toe clamp 114 and the base bracket 102. FIGS. 11-13 depict the locking arrangement 110 in three exemplary locked positions, including a neutral angle (FIG. 11; i.e., straight ahead from the outboard motor 12); a left-hand angle (FIG. 12; i.e., at an angle towards the port side of the outboard motor 12); and a right-hand angle (FIG. 13; i.e., at an angle towards the starboard side of the outboard motor 12). In each locked position, the male portion 116 is engaged with (e.g., received and retained by) the female portion 118. In the unlocked position, the male portion 116 is removed from (e.g., disengaged with) and thus is not retained by the female portion 118.

The exact location and configuration of the male-female connector can vary from that which is shown. In the illustrated example, the male and female portions 116, 118 are similarly constructed; however in other examples the male and female portions 116, 118 are differently constructed. For discussion purposes, the male portion 116 is disposed on the toe clamp 114 and the female portion 118 is disposed on the base bracket 102; however this is only an example and in other examples, the male portion 116 can be located on the base bracket 102 and the female portion 118 on the toe clamp 114. In other examples, the male-female connector can be located on the base bracket 102 and chassis bracket 106, instead of on the toe clamp 114. Alternate configurations are contemplated by this disclosure and will be apparent to one having ordinary skill in the art in view of the various examples that are further described herein below. For example, see the fourth embodiment, FIGS. 18-20, further explained herein below, which omits the toe bracket and has a differently configured male-female connector.

In the first embodiment shown in FIGS. 8-13, the male portion 116 includes a plurality of recesses and teeth 120 (see FIG. 11) on the front portion of the toe clamp 114 and the female portion 118 includes a plurality of teeth and recesses 122 (see FIG. 9) on the rear portion of the chassis bracket 106. The recesses 122 are aligned next to each other and configured to interlock with the teeth 120 on the toe clamp 114, as shown, for example, in FIGS. 11-13. Each recess 122 corresponds to a different angle at which the chassis bracket 106 and tiller chassis 16 extends from the base bracket 102 and outboard motor 12. This example is not limiting and other examples of male-female connectors are contemplated by the present disclosure, as demonstrated in the below-described second through sixth embodiments.

It will thus be understood by those having ordinary skill in the art that the adjustable mount 100 advantageously facilitates operator-adjustment of the angular orientation of the tiller 10 with respect to the outboard motor 12. This provides both ergonomic and performance advantages over the prior art. According to the first embodiment, the operator can reposition the angle of the tiller 10 to a desired angle by removing the locking fastener 112 from the toe clamp 114 and then removing the toe clamp 114 from engagement with the chassis bracket 106 and base bracket 102. This removes the teeth 120 from the recesses 122 and allows the chassis bracket 106 to be removed from the base bracket 102 and/or pivoted with respect the vertical axis 113 (i.e. pivot about the vertical pivot shaft 124). Once the chassis bracket 106 and associated tiller chassis 16 are repositioned at a desired angle with respect to the base bracket 102 and associated outboard motor 12, the toe clamp 114 can be re-engaged with the base bracket 102 and chassis bracket 106 via engagement between the teeth 120 and recesses 122. Thereafter, the locking fastener 112 can be reengaged with the base bracket 102 and toe clamp 114, thus securing the components together and fixing the tiller 10 at the new desired angle.

Figure 14:
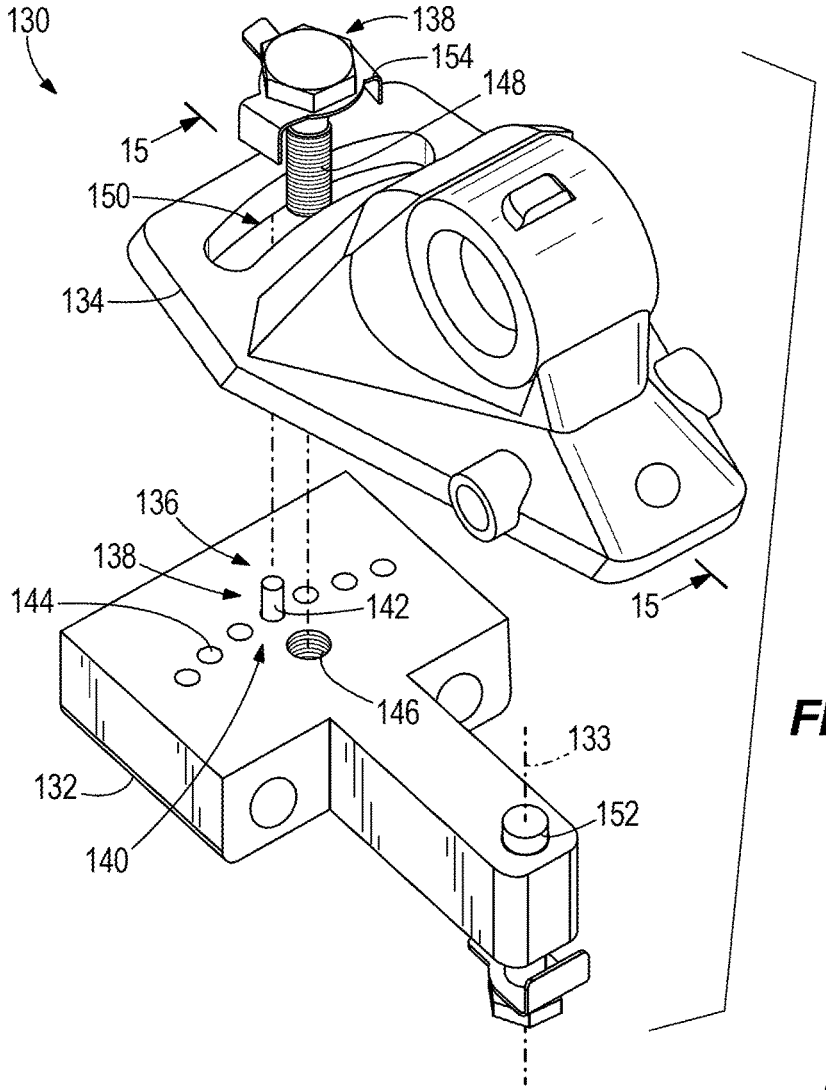
FIG. 14 is an exploded view of a second embodiment of the adjustable mount.
Figure 15:
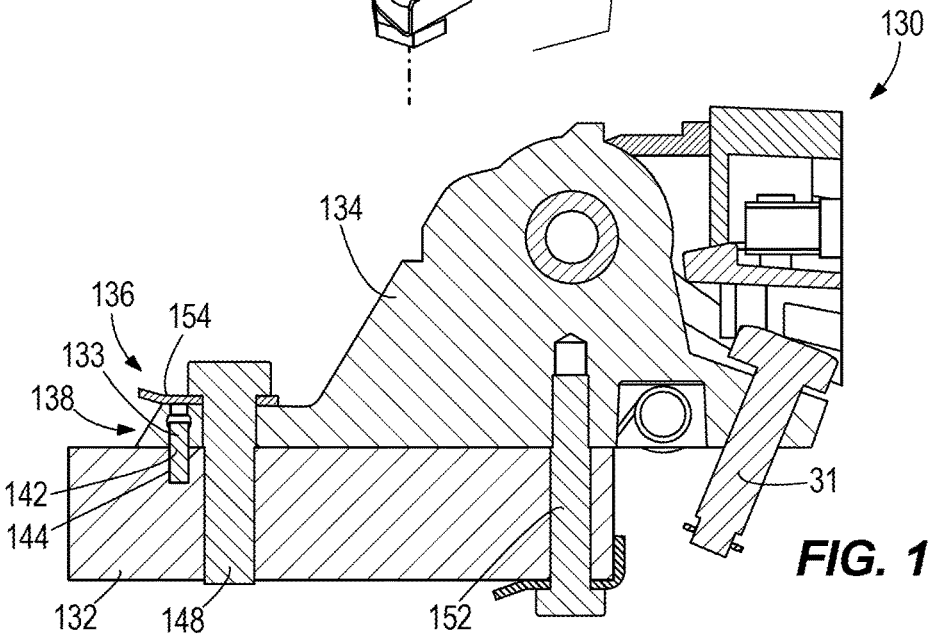
FIG. 15 is a view of section 15-15 taken in FIG. 14.

FIGS. 14 and 15 depict a second embodiment of an adjustable mount 130 for use with the tiller 10 and the outboard motor 12. Similar to the first embodiment, the adjustable mount 130 includes a base bracket 132 configured to be rotationally fixed with respect to the outboard motor 12, a chassis bracket 134 that couples the base bracket 132 to the tiller chassis 16, and a locking arrangement, generally referred to at 136, which is movable into and between a locked position (FIG. 15) wherein the chassis bracket 134 remains rotationally fixed with respect to the base bracket 132, and an unlocked position (FIG. 14) wherein the chassis bracket 134 is freely movable with respect to the base bracket 132 into and out of a plurality of angular positions.

Similar to the first embodiment, the adjustable mount 130 has a vertical pivot shaft 152 that extends along a vertical axis 135, through the base bracket 132 and into the chassis bracket 134. In the unlocked position, the chassis bracket 134 is rotatable with respect to the base bracket 132 about the vertical pivot shaft 152. The locking arrangement 136 includes a male-female connector having a male portion 138 and a female portion 140. In the locked position, the male portion 138 is received and retained by the female portion 140 such that the chassis bracket 134 and associated tiller chassis 16 remain rotationally fixed with respect to the base bracket 132 and associated outboard motor 12. In the unlocked position, the male portion 138 is separated from the female portion 140 such that the chassis bracket 134 and associated tiller chassis 16 can be pivoted about the vertical axis 113 via the vertical pivot shaft 152 and angularly repositioned with respect to the base bracket 132 and associated outboard motor 12.

Unlike the first embodiment, the male portion 138 includes a dowel pin 142 and the female portion 140 includes a plurality of holes 144 formed in the base bracket 132, at least one hole 133 formed in the chassis bracket 134. The male portion 138 further includes a locking fastener 148 that engages with a threaded hole 146 formed in the base bracket 132. In this example the threaded hole 146 is also part of the female portion. The dowel pin 142 is sized and shaped to fit in each of the respective holes 144 and 133. The locking fastener 148 and dowel pin 142 thereby rotationally fix the chassis bracket 134 and base bracket 132 together (see FIG. 15). In use, the operator can adjust the angle at which the chassis bracket 106 and associated tiller chassis 16 extend with respect to the base bracket 132 and associated outboard motor 12 by removing the locking fastener 148 from the threaded hole 146 in the base bracket 132 and then lifting and/or pivoting the chassis bracket 134 off of and/or away from the base bracket 132. Once the chassis bracket 134 is so removed, the operator can manually move the dowel pin 142 to a different selected one of the plurality of holes 144, which each correspond to a different angular position of the chassis bracket 134 and tiller chassis 16. Thereafter, the chassis bracket 134 can be placed back down onto and/or rotated onto the base bracket 132 so that the dowel pin 142 is re-inserted into the hole 133 in the chassis bracket 134. The locking fastener 148 is then re-inserted into the threaded hole 146 via an arc-shaped through-bore 150 in the chassis bracket 134 and tightened down to thereby secure the chassis bracket 134 onto the base bracket 132. A locking washer 154 is disposed on the locking fastener 148 and configured to engage with interior surfaces of the arc-shaped through-bore 150 to further rotationally fix the components together.

Figure 16:
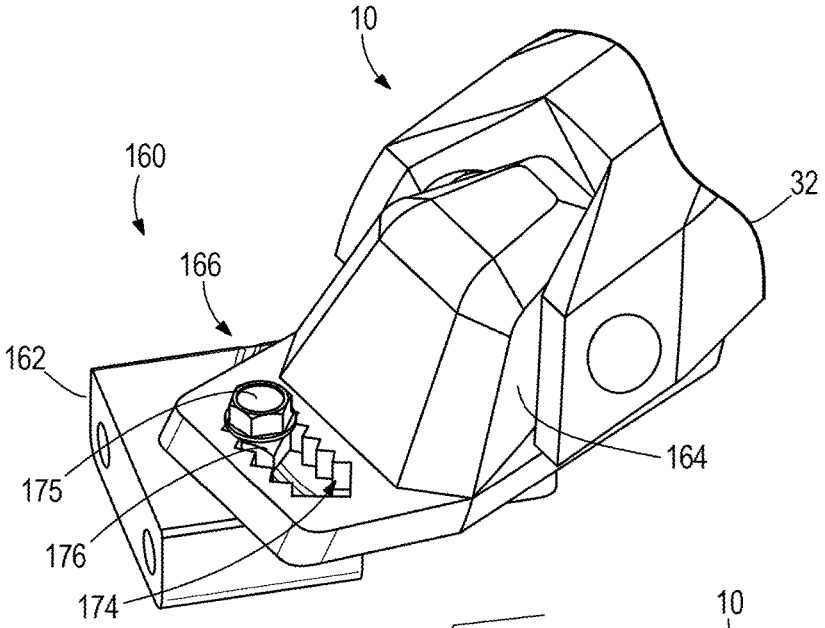
FIG. 16 is a perspective view of a third embodiment of the adjustable mount.
Figure 17:
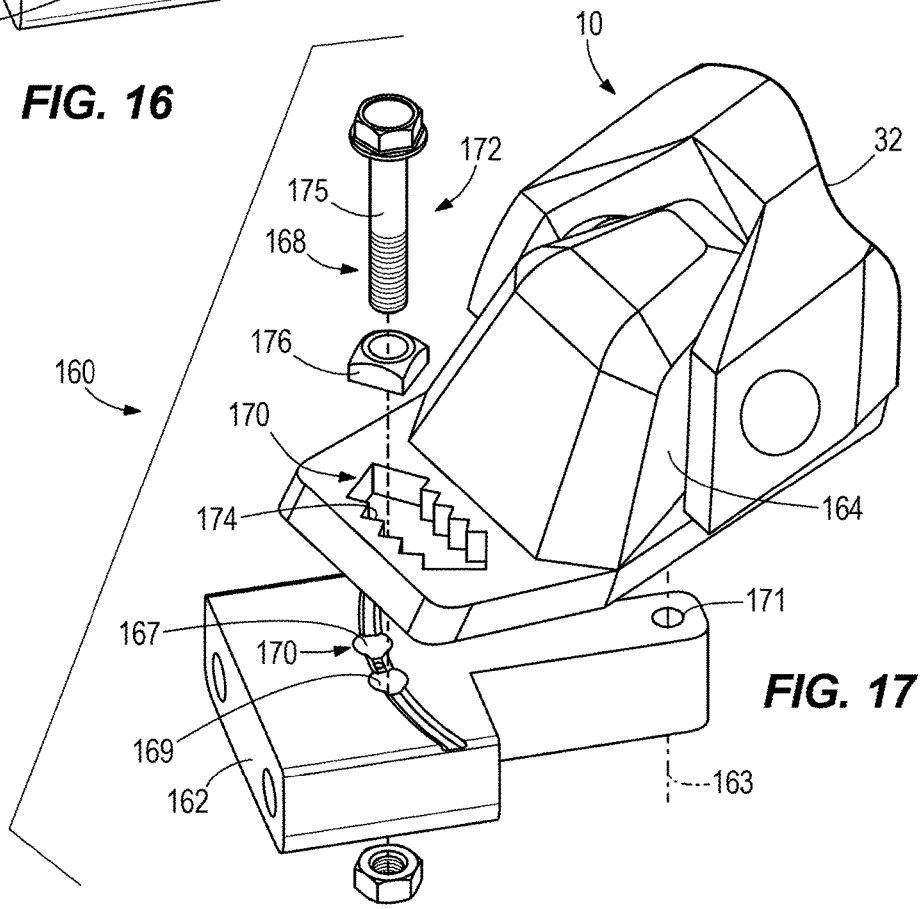
FIG. 17 is an exploded view of the adjustable mount of FIG. 16.

FIGS. 16 and 17 depict a third embodiment of an adjustable mount 160. Similar to the above-described embodiments, the adjustable mount 160 has a base bracket 162 that is configured to be rotationally fixed with respect to the outboard motor 12 and a chassis bracket 164 that is configured to be rotationally fixed with respect to the tiller chassis 16. A locking arrangement, shown generally at 166, is movable into and between a locked position (e.g., FIG. 16) wherein the chassis bracket 164 is rotationally fixed with respect to the base bracket 162 and an unlocked position (FIG. 17) wherein the chassis bracket 164 is freely movable (e.g., rotatable) about a vertical axis 163 with respect to the base bracket 162. Similar to the above-described embodiments, the adjustable mount 160 has a vertical pivot shaft (not shown, but configured similarly to the above-described embodiments) that extends through a hole 171 in the base bracket 162 and a threaded hole (not shown, but configured similarly to the above-described embodiments) in the chassis bracket 164. The chassis bracket 164 is rotatable about the vertical pivot shaft with respect to the base bracket 162 when the locking arrangement 166 is in the unlocked position (FIG. 17). Similar to the above-described embodiments, the locked position is one of a plurality of locked positions into and between which the locking arrangement 166 is movable. In each of the locked positions, the chassis bracket 164 extends at different respective fixed angle with respect to the base bracket 162 and outboard motor 12. Similar to the above-described embodiments, the locking arrangement 166 includes a male-female connector having a male portion 168 and a female portion 170. In the locked position, the male portion 168 is received and retained by the female portion 170. In the unlocked position, the male portion 168 is separated from the female portion 170.

Unlike the above-described embodiments, the male portion 168 of the adjustable mount 160 includes a geometric key 172. The female portion 170 includes a plurality of recesses 174 formed in the chassis bracket 164. Each recess 174 is configured to interlock with the geometric key 172 when the locking arrangement 166 is in one of the plurality of different locked positions. Each recess 174 thus corresponds to a different angular position of the chassis bracket 164 and tiller chassis 16 with respect to the base bracket 162 and outboard motor 12. The geometric key 172 includes a bolt 175 and a locking fastener 176, which is sized and shaped to engage with the recesses 174 to thereby rotationally fix the chassis bracket 164 with respect to the base bracket 162. The female portion 170 further includes a pair of threaded holes 167, 169 in the base bracket 162, each for engaging with the bolt 175 of the geometric key 172. The threaded hole 167 is for engaging the bolt 175 in a left-handed orientation and the threaded hole 169 is for engaging the bolt 175 in a right-handed orientation.

In use, the operator can adjust the fixed angle at which the chassis bracket 164 and associated tiller chassis 16 extends from the base bracket 162 by removing or loosening the bolt 175 from whichever hole 167, 169 it is currently registered and also removing the locking fastener 176 from the recesses 174. With the bolt 175 removed or loosened and the locking fastener 176 removed, the chassis bracket 164 can be manually rotated with respect to the base bracket 162 about the noted vertical pivot shaft. Once the chassis bracket 164 is re-positioned at a desired angle, the bolt 175 can be tightened down until the locking fastener 176 is engaged with a corresponding recess 174, thus locking the chassis bracket 164 with respect to the base bracket 162.

Figure 18:
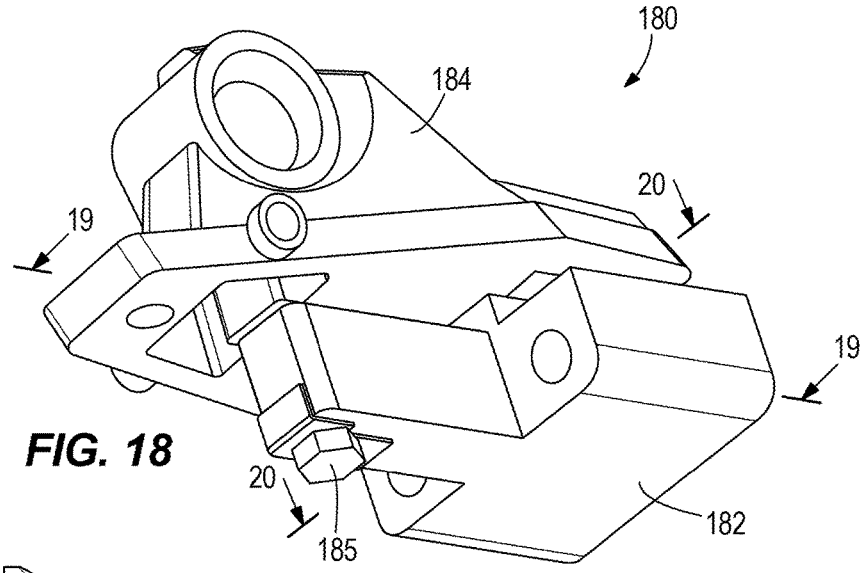
FIG. 18 is a perspective view of a fourth embodiment of the adjustable mount.
Figure 19:
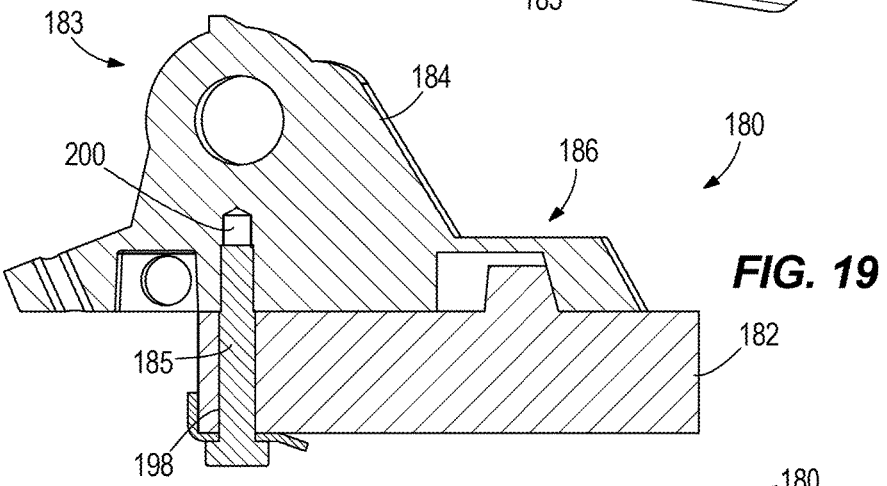
FIG. 19 is a view of section 19-19 taken in FIG. 18.
Figure 20:
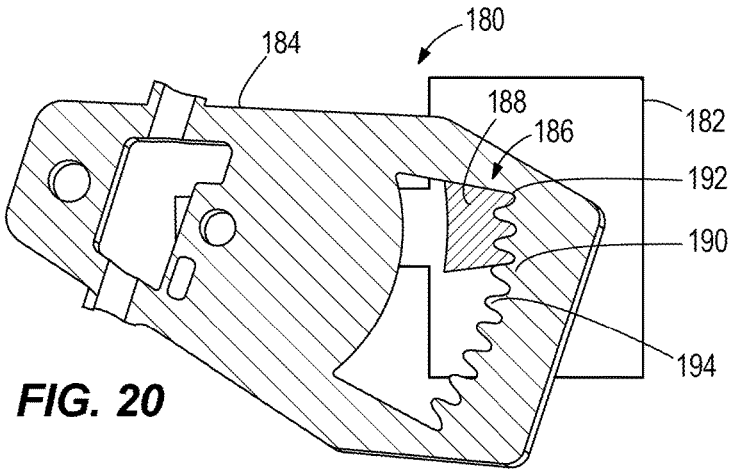
FIG. 20 is a view of section 20-20 taken in FIG. 18.

FIGS. 18-20 depict a fourth embodiment of an adjustable mount 180. Similar to the above-described embodiments, the adjustable mount 180 includes a base bracket 182 configured to be rotationally fixed with respect to the outboard motor 12, a chassis bracket 184 that fixes the base bracket 132 to the tiller chassis 16, and a locking arrangement, generally referred to at 186, which is movable into and between a locked position (FIGS. 18-20) wherein the chassis bracket 184 remains rotationally fixed with respect to the base bracket 182, and an unlocked position (not shown) wherein the chassis bracket 184 is freely movable with respect to the base bracket 182.

Similar to the above-described embodiments, the locking arrangement 186 includes a male-female connector having a male portion 188 and a female portion 190. In the locked position, the male portion 188 is received and retained by the female portion 190 such that the chassis bracket 184 and associated tiller chassis 16 remain fixed with respect to the base bracket 182 and associated outboard motor 12. In the unlocked position, the male portion 188 is separated from the female portion 190 such that the chassis bracket 184 and associated tiller chassis 16 can be moved with respect to the base bracket 182 and associated outboard motor 12.

Similar to the first embodiment described herein with reference to FIGS. 9-13, the male portion 188 includes a plurality of recesses and teeth 192 and the female portion comprises a plurality of teeth and recesses 194 that are configured to interlock with the plurality of teeth 192 when the locking arrangement 136 is in the locked position.

Unlike the first embodiment, the plurality of teeth 192 are disposed on the base bracket 182 and the plurality of recesses 194 are formed in the chassis bracket 184. Each of the recesses 194 corresponds to a different angular position of the chassis bracket 184 and associated tiller chassis 16. A locking fastener 185 extends through a through-bore 198 in the base bracket 182 and into a threaded hole 200 in the chassis bracket 184 to lock the base bracket 182 and chassis bracket 184 in position with respect to each other.

To change the angle at which the chassis bracket 184 and associated tiller chassis 16 extends from the base bracket 182 and associated outboard motor 12, the operator can remove the locking fastener 185 and slide the chassis bracket 184 laterally with respect to the base bracket 182 (see arrow 183), thus removing the recesses 194 from the teeth 192. Thereafter the chassis bracket 184 and associated tiller chassis 16 can be rotated to a desired rotational position. Thereafter, the operator manually slides the chassis bracket 184 laterally with respect to the base bracket 182 (i.e., opposite arrow 183) until the teeth 192 engage with the recesses 194. Once engaged, the operator can insert the locking fastener 185 into the through-bore 198 and tighten it with respect to the threaded hole 200, thereby locking the locking arrangement 186 in the desired locked position.

Figure 21:
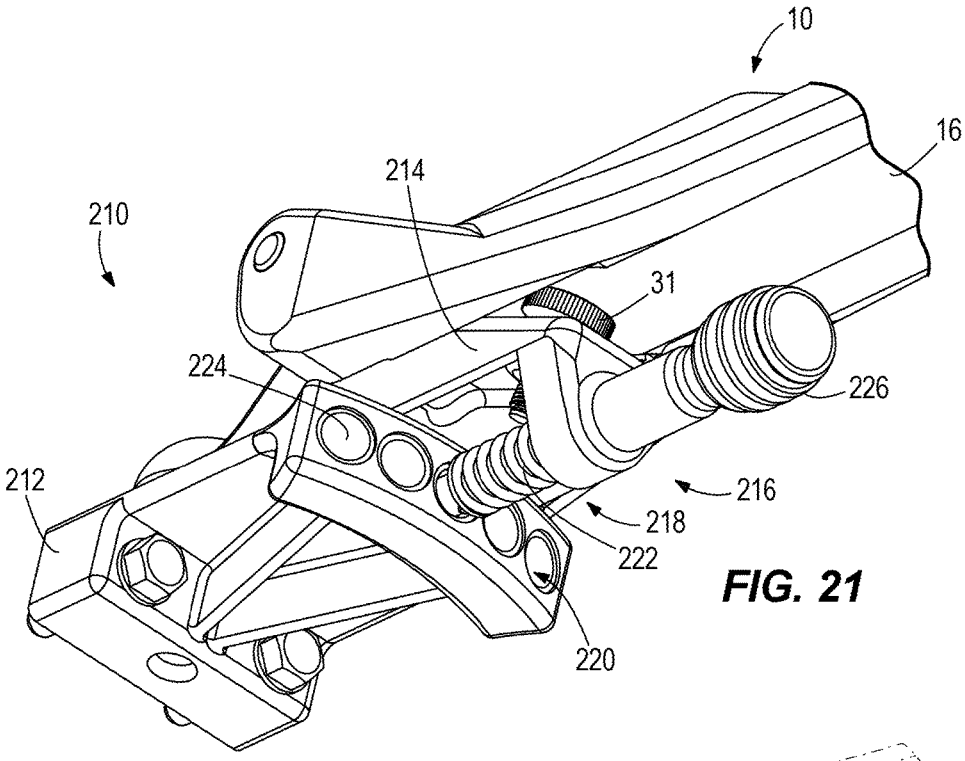
FIG. 21 is a perspective view of a fifth embodiment of the adjustable mount.
Figure 22:
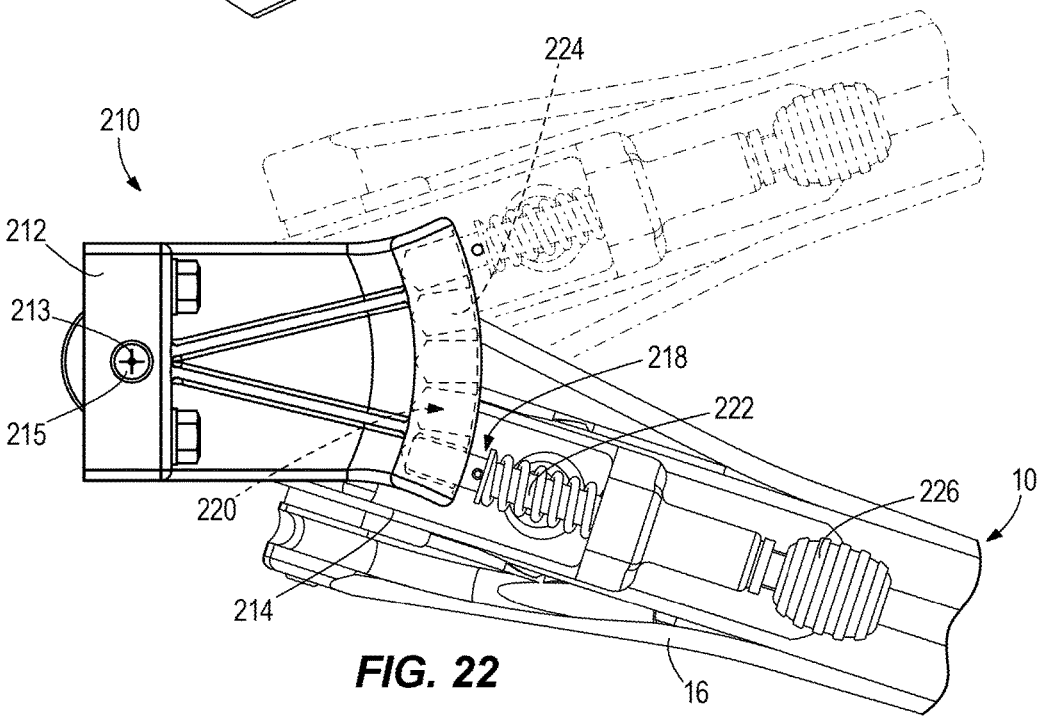
FIG. 22 is a bottom view of the adjustable mount of FIG. 21, showing an alternate position thereof in dashed line format.
Figure 23:
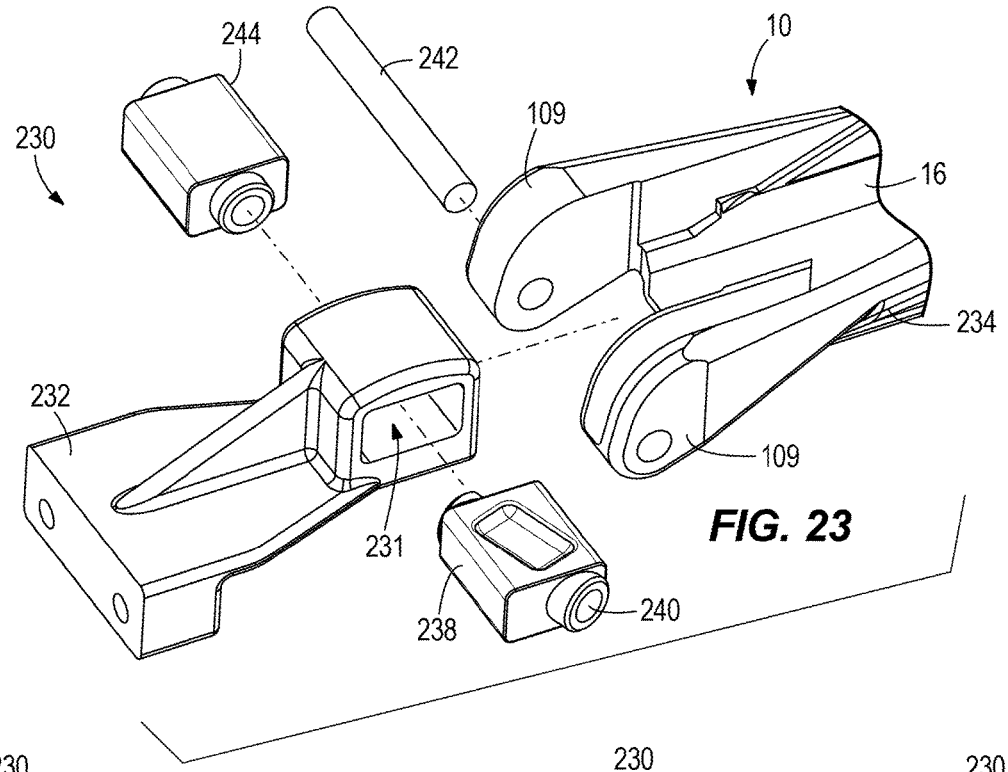
FIG. 23 is an exploded view of a sixth embodiment of the mount.
Figure 24:
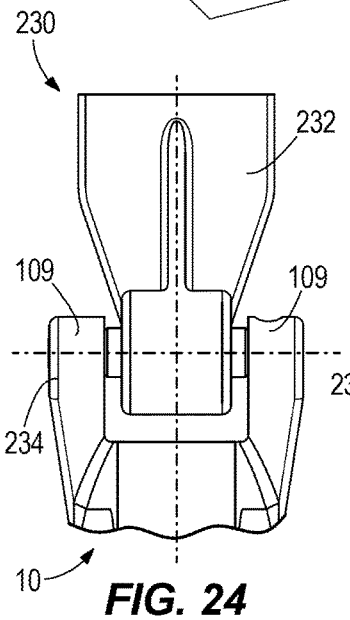
FIGS. 24-26 are sectional views showing the adjustable mount of FIG. 23 in various orientations.
Figure 25:
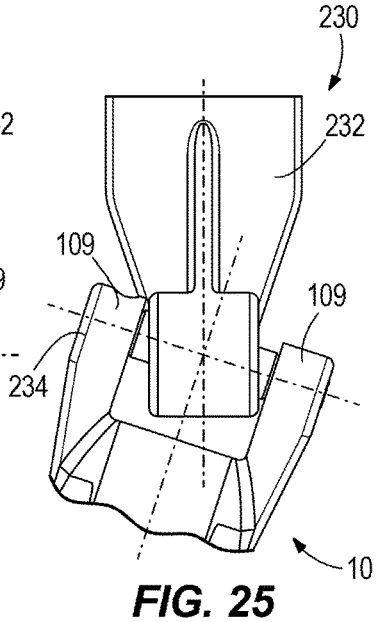
Figure 26:
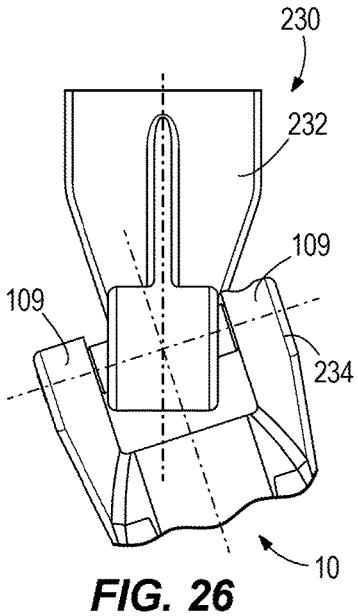

FIGS. 21 and 22 depict a fifth embodiment of an adjustable mount 210. Similar to the above-described embodiments, the adjustable mount 210 includes a base bracket 212 configured to be rotationally fixed with respect to the outboard motor 12, a chassis bracket 214 that is configured to be rotationally fixed with respect to the tiller chassis 16, and a locking arrangement, generally referred to at 216, which is movable into and between a locked position (FIGS. 21 and 22) wherein the chassis bracket 214 remains rotationally fixed with respect to the base bracket 212, and an unlocked position (not shown) wherein the chassis bracket 214 is freely movable with respect to the base bracket 212.

Similar to the above-described embodiments, a vertical pivot shaft 215 extends along a vertical pivot axis 213, through the base bracket 212 and into the chassis bracket 214. In the unlocked position, the chassis bracket 214 is rotatable with respect to the base bracket 212 about the vertical pivot shaft 215. Similar to the first embodiment, the locking arrangement 216 includes a male-female connector having a male portion 218 and a female portion 220. In the locked position, the male portion 218 is received and retained by the female portion 220 such that the chassis bracket 214 and associated tiller chassis 16 remain fixed with respect to the base bracket 212 and associated outboard motor 12. In the unlocked position, the male portion 218 is separated from the female portion 220 such that the chassis bracket 214 and associated tiller chassis 16 can be pivoted about the vertical pivot axis 213 with respect to the base bracket 212 and associated outboard motor 12.

Unlike the above-described embodiments, the male portion 218 includes a spring-loaded pin 222 and the female portion comprises a plurality of holes 224 that are sized and shaped to receive the spring-loaded pin 222. Each hole 224 corresponds to a different angular position of the chassis bracket 214 and tiller chassis 16 with respect to the base bracket 212 and associated outboard motor 12. A handle 226 is coupled to the spring-loaded pin 222 and configured such that manually pulling on the handle 226 compresses the spring-loaded pin 222 against the chassis bracket 214 and removes the spring-loaded pin 222 from the hole 224 in which the spring-loaded pin 222 resides. Removing the spring-loaded pin 222 from the noted hole 224 unlocks the chassis bracket 214 from the base bracket 212 such that the chassis bracket 214 and associated tiller chassis 16 can be manually pivoted about the vertical pivot axis 213 until a different one of the holes 224 is aligned with the spring-loaded pin 222. Once the tiller chassis 16 is oriented into a desired angle with respect to the base bracket 212 and associated outboard motor 12, the handle 226 can be manually released, which allows the spring-loaded pin 222 to resiliently spring back into a locked position wherein the spring-loaded pin 222 engages with the aligned hole 224.

FIGS. 23-26 depict a sixth embodiment of an adjustable mount 230. The adjustable mount 230 includes a base bracket 232 configured to be rotationally fixed with respect to the outboard motor 12 and a locking arrangement, generally referred to at 236. The locking arrangement includes a bushing 238 that is configured for mounting in a channel 231 in the base bracket 232 in a first position (FIG. 25) wherein the bushing 238 is configured to couple the chassis bracket 234 to the base bracket 232 such that the chassis bracket 234 extends at a first angle with respect to the base bracket 232. The bushing 238 is also configured for mounting in the channel 231 in the base bracket 232 in an alternate, second position (FIG. 26) wherein the bushing 238 couples the chassis bracket 234 to the base bracket 232 at a different, second angle (in this example, an opposite angle) with respect to the base bracket 232. The configuration of the bushing 238 can vary from that which is shown. In the illustrated example, the bushing 238 includes an angled through-bore 240 that receives and retains a tilt shaft 242 onto which the chassis bracket 234 is mounted via the above-described opposing arms 109. Optionally, the locking arrangement 236 includes a second bushing 244 configured for mounting on the base bracket 232. The second bushing 244 couples the chassis bracket 234 to the base bracket 232 at a neutral angle (see FIG. 24), which is between the first and second angles.

In use, the locking arrangement 236 advantageously provides a kit by which the operator can easily select between several different mounting angles (FIGS. 24-26) by removing the bushing 238 from the channel 231 and re-inserting it in a different orientation. Alternately, the operator can select a different bushing (e.g. bushing 244), which provides a further different angle. Optionally, the bushings 238, 244, etc. can be made of a polymer/rubber material to provide better vibration isolation of the handle. The bushings 238, 244, etc. can also utilize ribs, holes, or other features to further enhance the vibration isolation characteristics of the bushing.

The orientation and configuration of the channel 231 and bushings 238, 244 can vary from that which is shown. For example, instead of being oriented transversely to the steering arm, the channel 231 can be axially aligned with the steering arm. In such an example, the bushings 238, 244, etc. can be axially inserted into and nest in the channel 231 and further provide the above-described angled through-bore 240 for receiving the tilt shaft 242. Flipping the orientation of the bushing 238, 244, etc. 180° thus provides alternate mounting arrangements, similar to the embodiment shown.

Advantageously, several of the examples described herein above allow the operator to optimize the ergonomics of the tiller for specific boat set-up and hand preference. Several of the examples do not require removal of components to make this adjustment. Advantageously, several of the examples provide early indication if for example a fastener loosens, as the steering response may become somewhat sloppy, however, control will still be provided. Several of the examples provide redundant security of adjustment. For example, if a fastener disengages, the locking mechanism typically will still allow control without excessive free play. High resolution adjustment is thus contained within a compact volume.

FIGS. 27-34 depict another example of a tiller 300 having a tiller body 302 that is elongated along a tiller axis 304 between a fixed end 306 and a free end 308. Similar to the above-described examples, the tiller 300 has a throttle grip 310 disposed on the free end 308. The throttle grip 310 is rotatable about the tiller axis 304. A throttle linkage (shown generally at 312 in FIGS. 30 and 31) is coupled to the throttle grip 310 and configured to control the throttle (not shown) of the outboard motor 12 based upon manual rotation of the throttle grip 310 about the tiller axis 304. The particular configuration of the throttle linkage 312 can vary, as will be apparent from a comparison of the example shown in FIGS. 27-34 and the example described hereinbelow with reference to FIGS. 38 and 39. In FIGS. 27-34 (particularly see FIG. 30), the throttle linkage 312 generally includes a throttle shaft 314 that is coupled to the throttle grip 310 such that manual rotation of the throttle grip 310 causes commensurate rotation of the throttle shaft 314. A throttle pulley 316 is disposed on the throttle shaft 314 such that rotation of the throttle shaft 314 causes commensurate rotation of the throttle pulley 316. Another throttle pulley 318 (see FIG. 31) is disposed on the throttle of the outboard motor 12 and is connected to the throttle pulley 316 by a pair of pulley cables 320, such that rotation of the throttle grip 310 causes commensurate rotation of the throttle pulley 316, which in turn pushes or pulls on respective ones of the pair of pulley cables 320, to thereby cause commensurate rotation of the throttle pulley 318. Rotation of the throttle pulley 318 adjusts the position of the throttle on the outboard motor 12, as is conventional and thus not further depicted or described herein for brevity's sake.

Figure 30:
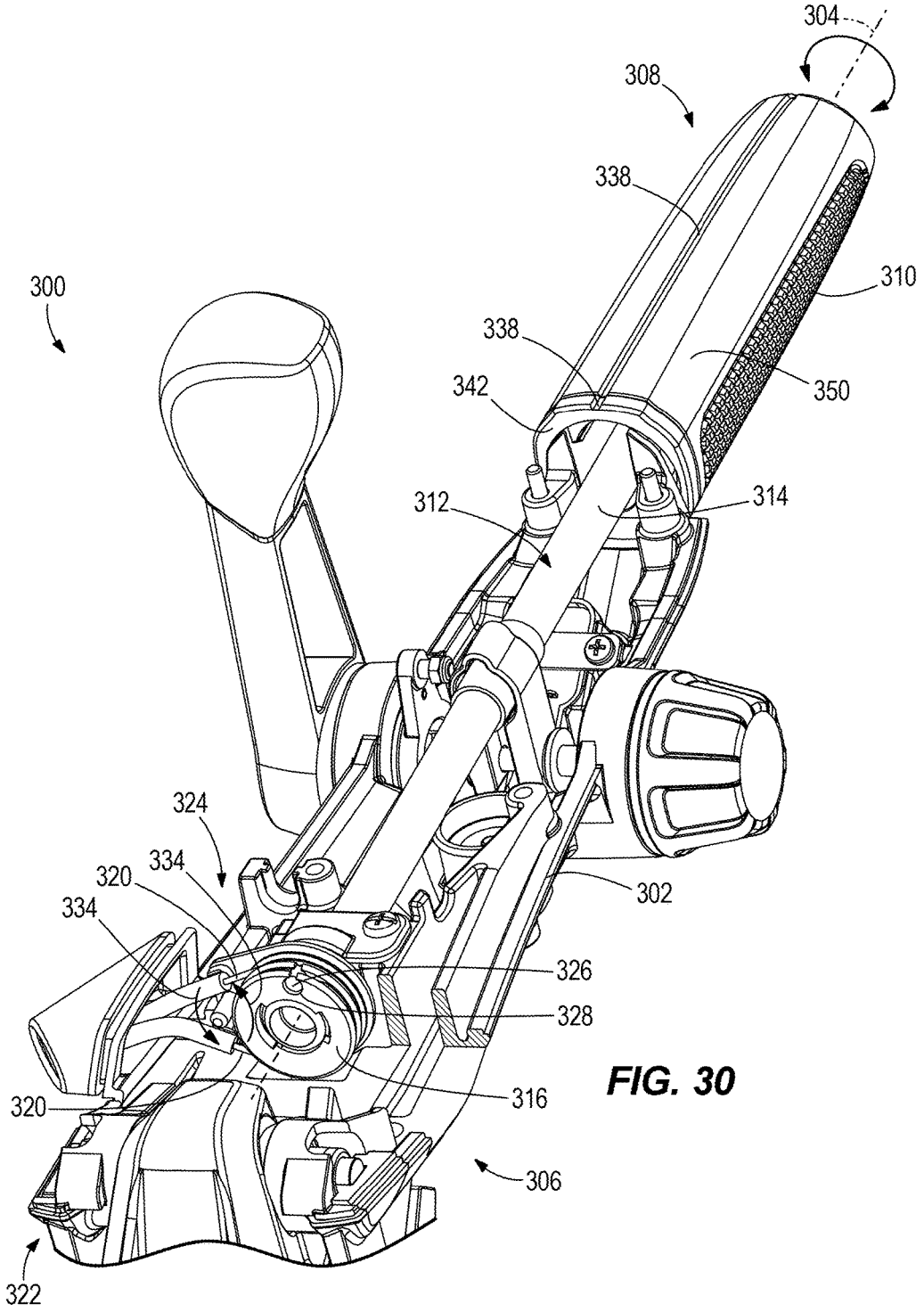
FIG. 30 is a perspective view of the tiller according to the present disclosure.

Referring to FIG. 30, the tiller 300 is coupled to the outboard motor 12 via any one of the above-described adjustable mounts (e.g., see the above described 100, 130, 160, 210). As explained herein above, the adjustable mount (given reference number 322 in FIG. 30) advantageously allows the operator to manually reposition the tiller 300 about a vertical (yaw) axis (see, e.g., FIGS. 11-13) with respect to the outboard motor 12, so that the tiller 300 can be fixed at any one of a plurality of fixed angles (e.g. yaw angles) with respect to the outboard motor 12, including a neutral position (see FIG. 11) and a variety of different left-handed and right-handed tiller positions (e.g., compare FIGS. 12 and 13).

During research and experimentation, the present inventors have determined that most tiller-controlled outboard motors are only configured for left-handed control, wherein the operator sits on the starboard-side of the outboard motor and controls the throttle and steering with the operator's left hand (see FIG. 12). During conventional left-handed control, the operator will rotate the throttle grip counter-clockwise (i.e. towards the operator, as viewed from in front of the outboard motor) to advance the throttle of the outboard motor. However, some operators prefer to use their right hand to control the tiller and thus prefer to sit on the port-side of the outboard motor. This is opposite of what is conventional. In such cases, with the tiller positioned in a right-handed position (see FIG. 13), the operator will need to rotate the grip clockwise (i.e. away from the operator, as viewed from in front of the outboard motor) to advance the throttle. The present inventors have found that this can be counterintuitive and thus could increase the chance of operator error.

Improved systems and methods are provided herein that allow the operator or a technician to pre-select (i.e. switch) the effects of throttle grip rotation based upon whether the adjustable mount 322 is positioned for left-handed control or right-handed control. This advantageously provides the operator with more intuitive and consistent controllability of the throttle in either position. Specifically, the operator or a technician can selectively set up the tiller such that the throttle will advance when the throttle grip is rotated over the top, towards the operator. Different mechanisms for switching between right-handed or left-handed control of the throttle grip are contemplated, as will be evident from the examples further described herein below.

Figure 29:
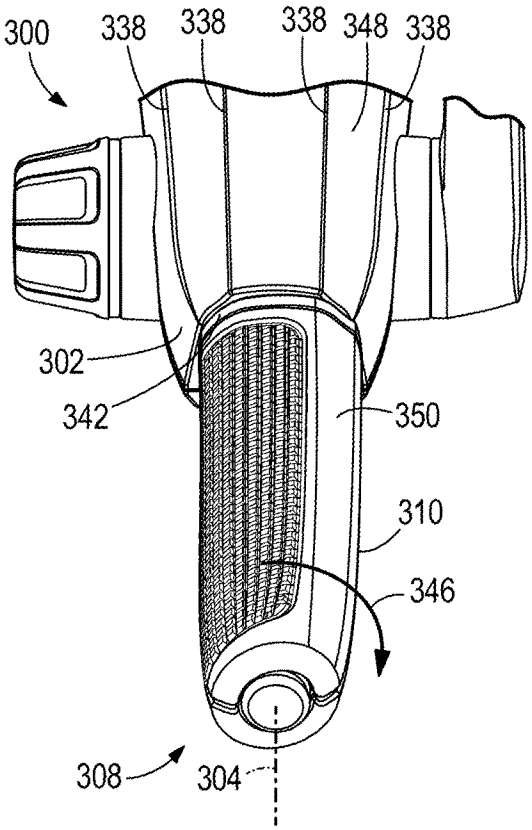
FIG. 27-29 depict a tiller according to the present disclosure in a left-handed wide open throttle position, an idle position, and a right-handed wide open throttle position, respectively.
Figure 27:
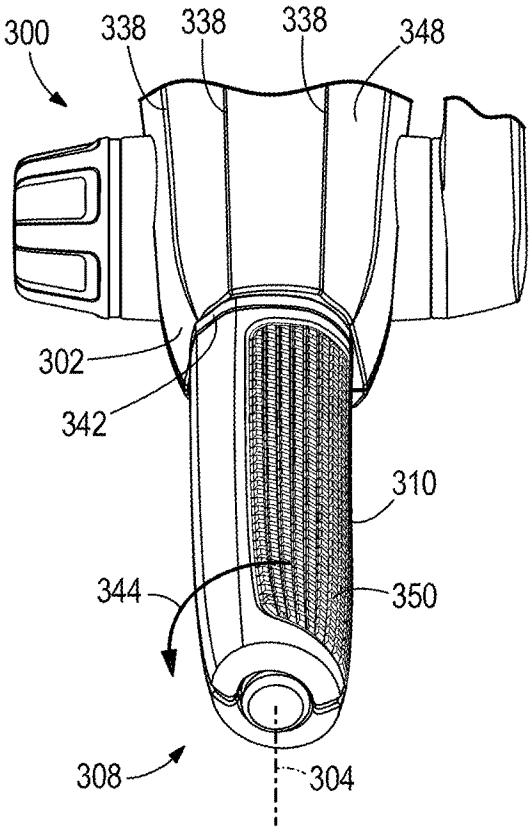

Referring now to FIGS. 27-30, the throttle grip 310 is rotatable through a first, left-handed range of motion 344 from an idle position (FIG. 28) in which the outboard motor 12 is controlled at idle speed to a first, left-handed wide open throttle position (FIG. 27) in which the outboard motor 12 is controlled at wide open throttle speed. The throttle grip 310 is alternately rotatable through a second, right-handed range of motion 346 from the idle position (FIG. 28) to a second, right-handed wide open throttle position (FIG. 29) in which the outboard motor 12 is controlled at wide open throttle speed. Here, the first and second wide open throttle positions are different. However, in certain examples, the first and second wide open throttle positions can be the same. As in the examples described hereinabove, the throttle grip 310 and associated connector ring 342 and top cover 348 on the tiller body 302 advantageously have alignment features 338 (e.g. longitudinal ribs and/or longitudinal channels) for providing the operator with visual and/or tactile feedback to distinguish when the throttle grip 310 is in the idle position (FIG. 28) and alternately when it is rotated away from the idle position (FIGS. 27, 29).

Figure 28:
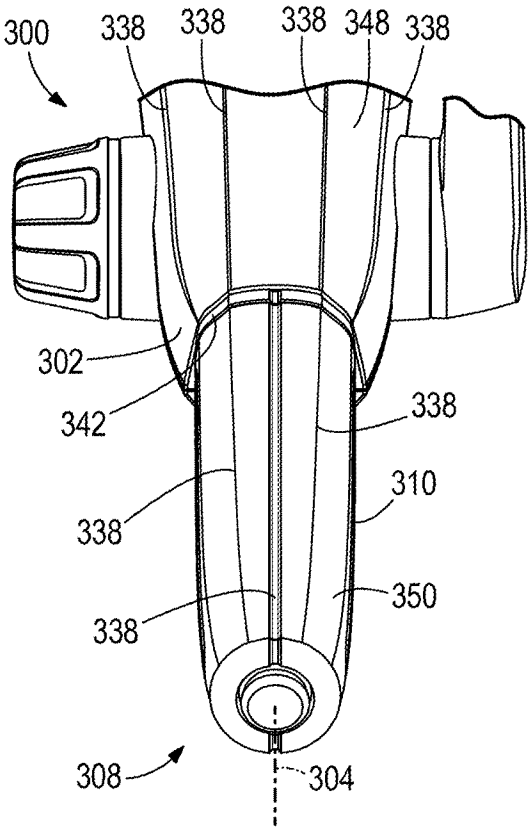

As shown in FIGS. 27-29, the first range of motion 344 is separate and distinct from the second range of motion 346. The first range of motion 344 is oppositely oriented (counter-clockwise in FIG. 27) with respect to the second range of motion 346 (clockwise in FIG. 29). The idle position (FIG. 28) of the throttle grip 310 is disposed between the first and second ranges of motion 344, 346 of the throttle grip 310, such that the first range of motion 344 extends in a first rotational direction (counter-clockwise) away from the idle position and the second range of motion 346 extends in an opposite, second rotational direction (clockwise) away from the idle position.

Figure 32:
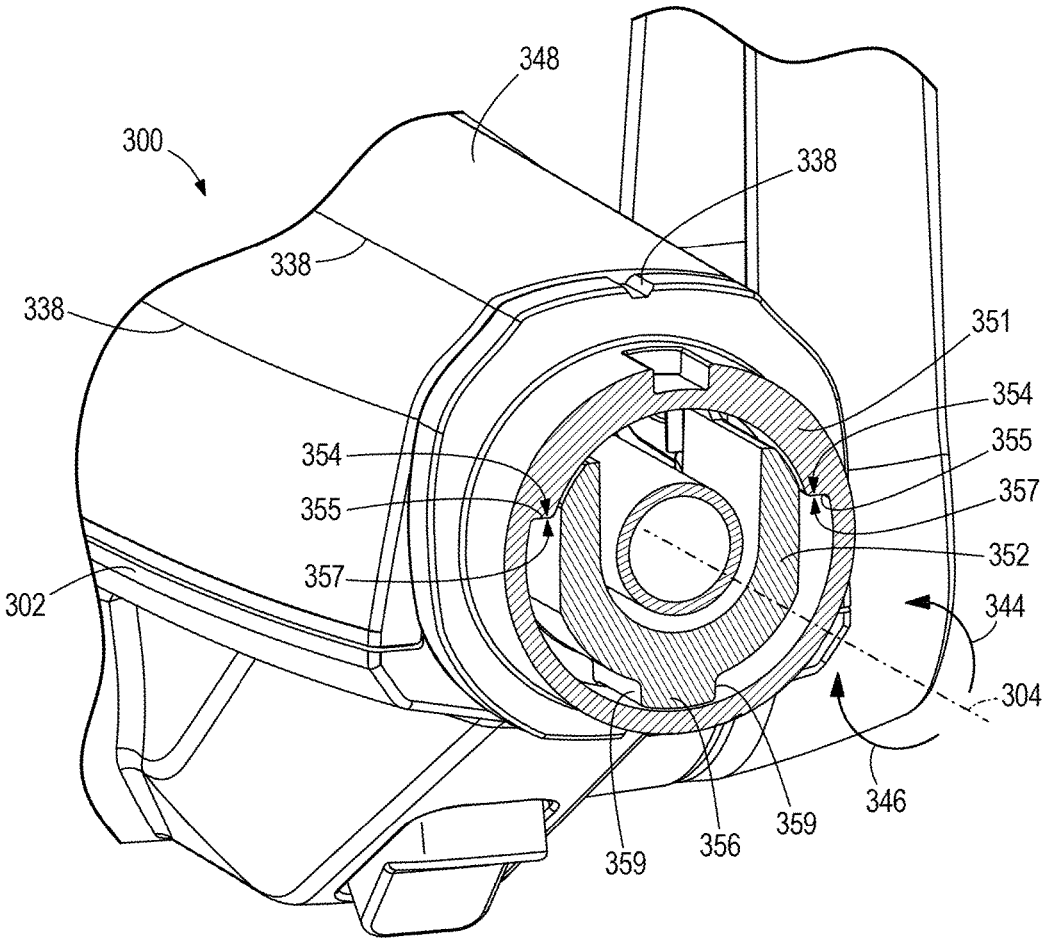
FIG. 32 is a view of Section 32-32, taken in FIG. 2.
Figure 33:
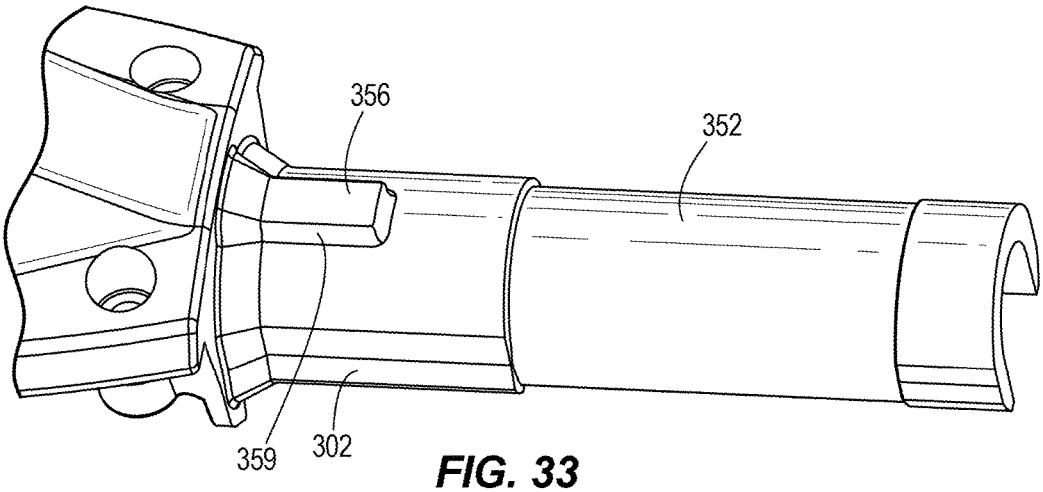
FIG. 33 is a bottom view of a tiller body.
Figure 34:
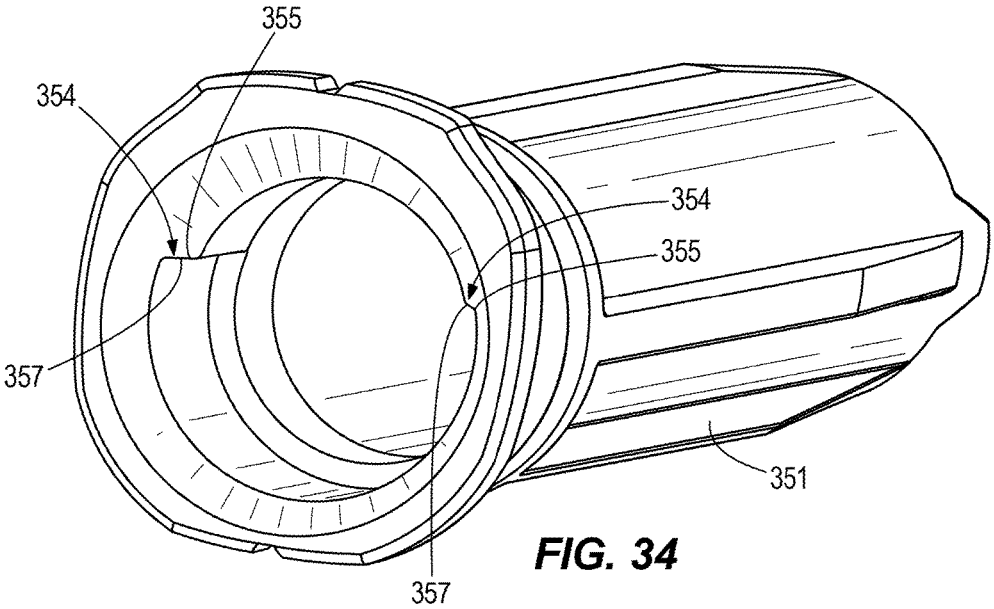
FIG. 34 is an end view of a portion of a throttle grip.

Referring now to FIGS. 32-34, the tiller 300 is specially configured to prevent over-rotation of the throttle grip 310 past the noted first and second wide open throttle positions (FIGS. 27 and 29). The manner in which over-rotation is prevented can vary from that which is shown. In the example shown, the throttle grip 310 includes an outer grip 350 (see FIG. 30) that covers a mantle 351. The outer grip 350 is affixed to the mantle 351 such that the outer grip 350 and mantle 351 are manually rotated together about the tiller axis 304 to thereby rotate the throttle shaft 314. FIG. 34 illustrates a portion of the mantle 351. The tiller body 302 includes a tiller chassis 352, which is co-axial with and disposed within the outer grip 350 and mantle 351 (see FIG. 32). The tiller chassis 352 is configured to support rotation of the outer grip 350 and mantle 351. A first engagement structure 354 is disposed on the mantle 351. In this example, the first engagement structure 354 includes axially extending ribs 355 providing radially outwardly opposed ledges 357. A second engagement structure 356 is disposed on the chassis 352. In this example, the second engagement structure 356 includes a pair of radially inwardly extending ledges 359 on the chassis 352. The respective radial inwardly extending ledges 359 are configured to engage the radially outwardly opposed ledges 357 when the throttle trip 310 is rotated into the respective first and second wide open throttle positions (FIGS. 27 and 29) to thereby prevent over-rotation past the first and second wide open throttle positions.

Figure 37:
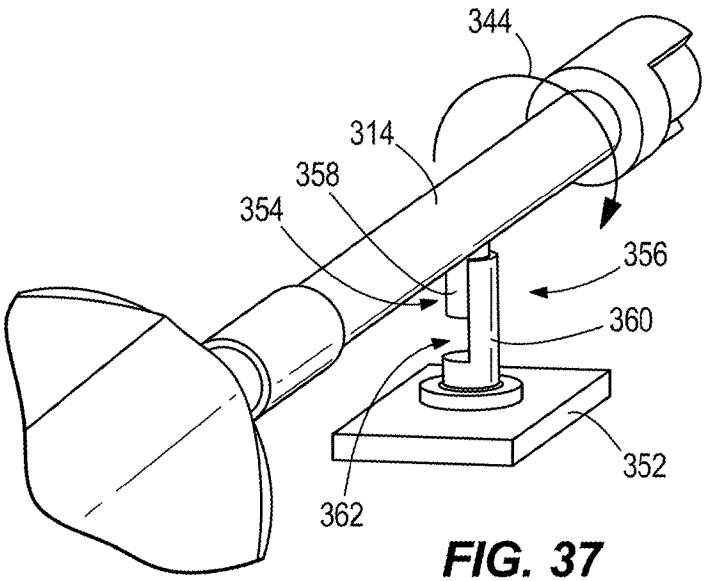
FIGS. 35-37 depict an example of engagement structure for preventing rotation of the throttle grip past a wide open throttle position.
Figure 35:
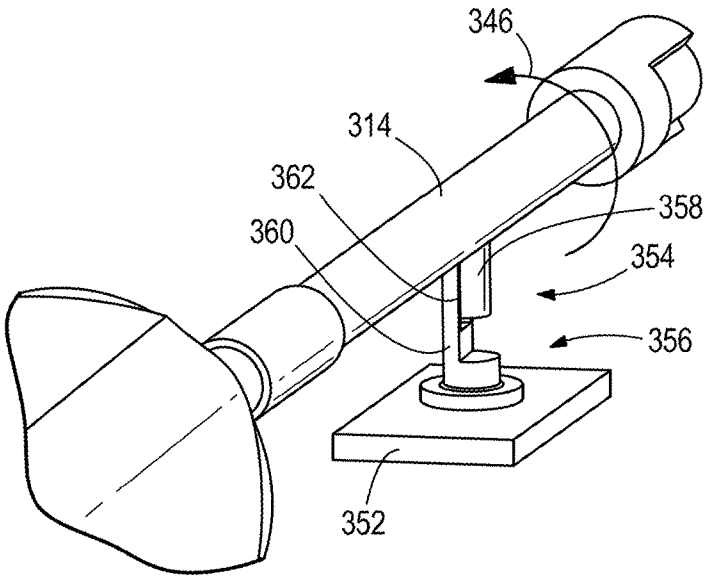
Figure 36:
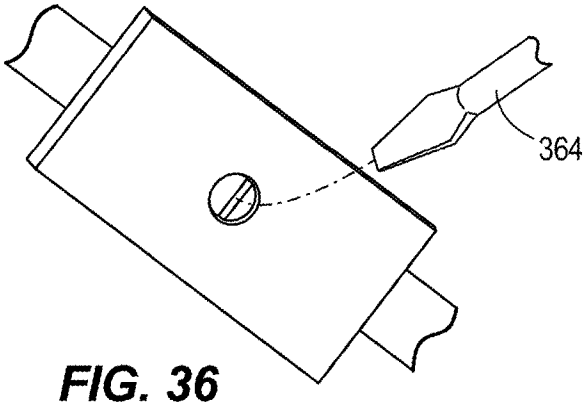

FIGS. 34-35 depict an alternate example of the first and second engagement structures 354, 356 for preventing over-rotation of the throttle grip 310 past the noted first and second wide open throttle positions (FIGS. 27 and 29). In this example, the first engagement structure 354 includes a radially extending member 358 on the throttle shaft 314 and the second engagement structure 356 includes a radially extending member 360 on the chassis 352 of the tiller body 302. The radially extending member 360 on the chassis 352 includes a contour 362 that is configured to receive (i.e. register with) the radially extending member 358 on the throttle shaft 314. As shown by comparison of FIGS. 35 and 37, over-rotation of the throttle shaft 314 (i.e. rotation past the respective wide open throttle position) is prevented by engagement between the radially extending member 358 that rotates with the throttle shaft 314 and the relatively fixed radially extending member 360 on the chassis 352. Optionally, the radially extending member 360 on the chassis 352 of the tiller body 302 is selectively positionable by the operator or more likely by a technician into and between a first, left-handed position (FIG. 34) wherein the contour 362 is oriented to receive the radially extending member 358 on the throttle shaft 314 when the throttle grip 310 is rotated to the end of the first range of motion 344, and alternately a second, right-handed position (FIG. 36) wherein the contour 362 is oriented to receive the radially extending member 358 on the throttle shaft 314 when the throttle grip 310 is rotated to the end of the second range of motion 346. In some examples, the position of the radially extending member 360 can be manually changed by rotating it with a manual tool, such as for example a screwdriver 364.

Figure 31:
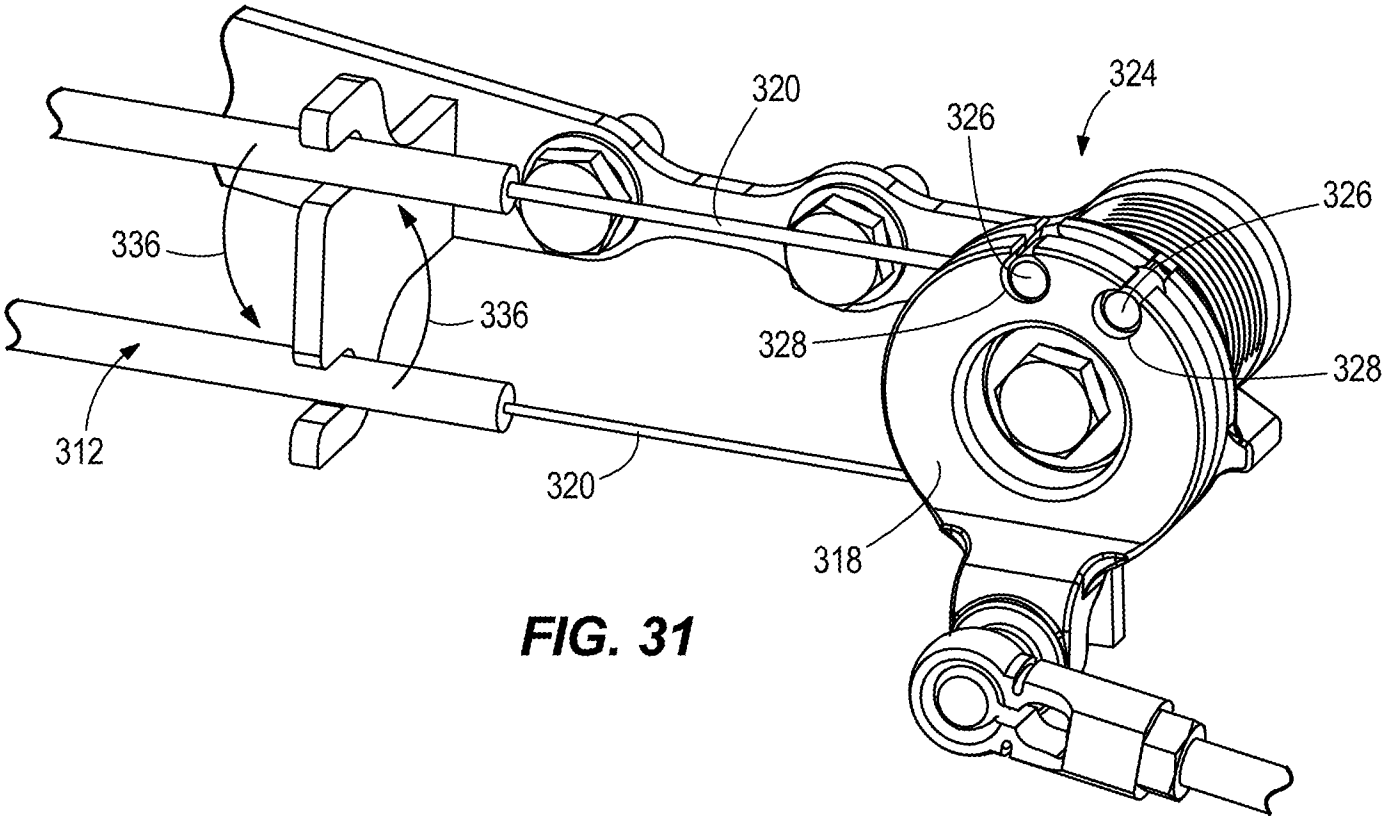
FIG. 31 is a view of a portion of a throttle linkage according to the present disclosure.

Referring to FIGS. 30 and 31, the tiller 300 includes a rotation direction switching mechanism (generally referred to generally at 324). In this example, the rotation direction switching mechanism 324 includes portions of the throttle linkage 312, namely the pulley 316 on the throttle shaft 314, the pulley 318 on the throttle of the outboard motor 12, and the pulley cables 320 that connect the throttle pulley 316 on the throttle shaft 314 to the pulley 318 on the throttle of the outboard motor 12. Advantageously, each of the pulley cables 320 is connected to the respective throttle pulleys 316, 318 in a non-permanent manner such that the ends of the pulley cables 320 can be easily removed from the throttle pulleys 316, 318. The manner of connection can vary from that which is shown. In the illustrated example, each pulley cable 320 has opposing ball ends 326 that are received in recesses 328 formed in the outer diameter of the respective pulleys 316, 318. As shown in FIGS. 30 and 31, the present inventors have realized that it is possible to switch the position or point of connection of one end of the pulley cables 320 to thereby correspond with the above-described left-handed and right-handed operation of the throttle grip 310. More specifically, the pulley cables 320 are positionable into a first position wherein rotation of the throttle grip 310 through the left-handed range of motion causes rotation of the pulley 318 on the throttle of the outboard motor 12, and alternately into a second position wherein rotation of the throttle grip 310 through the right-handed range of motion causes rotation of the pulley 318 on the throttle of the outboard motor 12. That is, the position of attachment of the pulley cables 320 at either the pulley 316 or the throttle pulley 318 can be switched by the operator or by the technician to thereby facilitate either right-handed or left-handed control of the throttle via the throttle grip 310. Arrows 334 in FIG. 30 show a switch of the position of attachment of the pulley cables 320 at the throttle pulley 316. Alternately, arrows 336 on FIG. 31 show a switch of the position of attachment of the pulley cables 320 at the throttle pulley 318. Thus, the present disclosure provides a unique method for switching the rotation direction of operation of the tiller 300 including the step of switching (i.e. flipping) the connection points at one end of the pair of cables 320 to thereby switch the functionality of the pulley cables 320 from a left-handed to a right-handed operation or from a right-handed to a left-handed operation.

Figure 38:
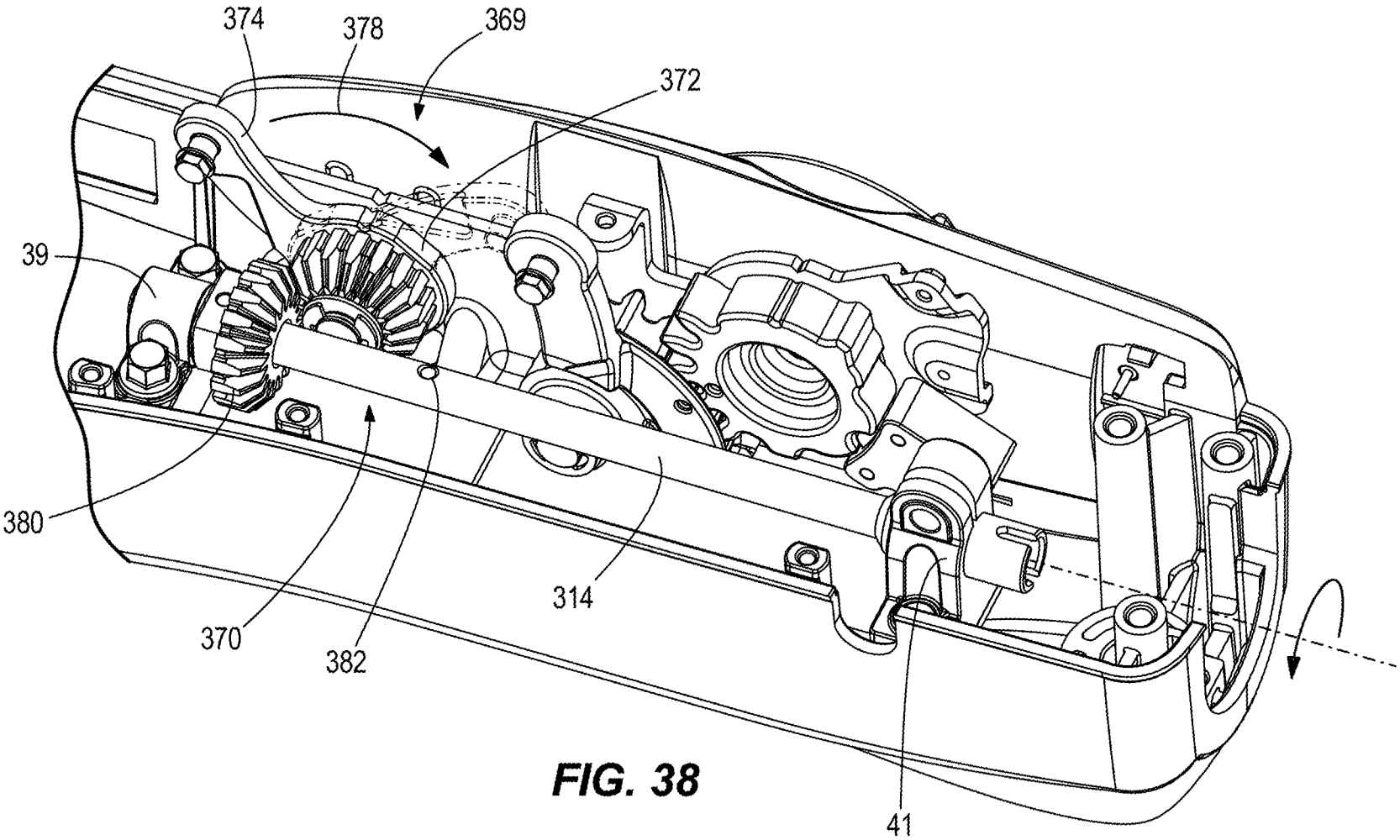
FIG. 38 is a partial view of another example of a tiller according to the present disclosure.
Figure 39:
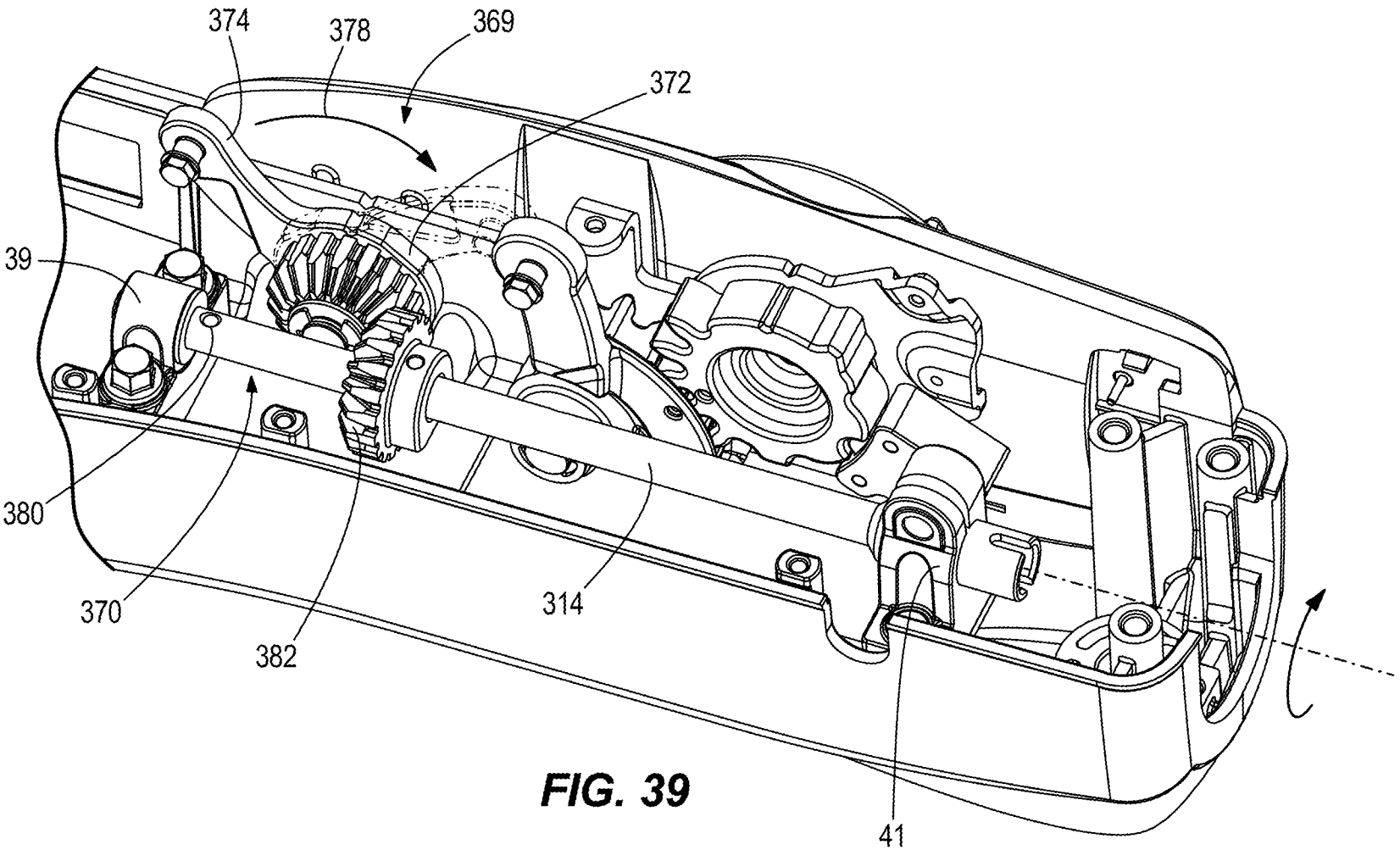
FIG. 39 is a view like FIG. 32 depicting an alternate throttle linkage position.
Figure 40:
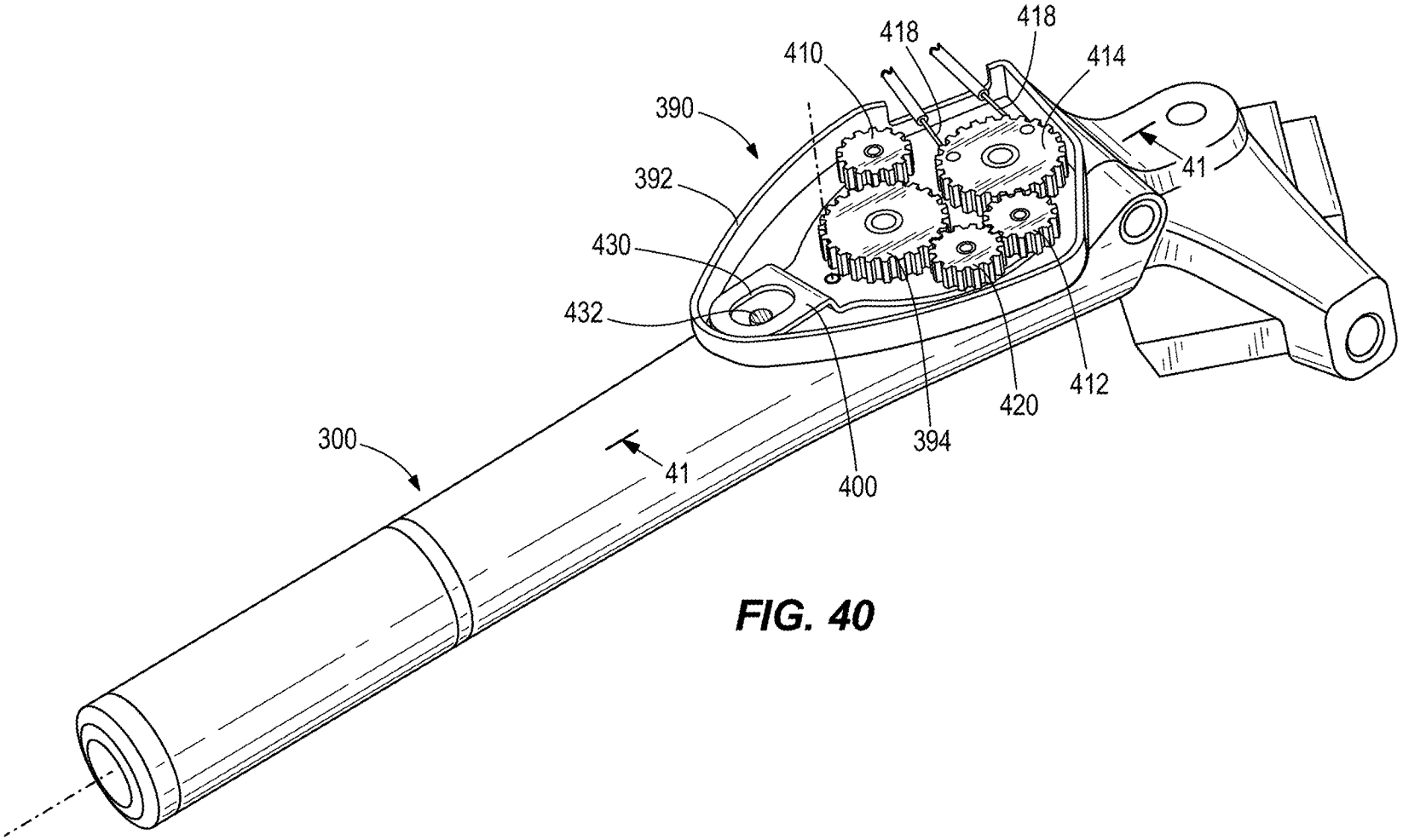
FIGS. 40-43 depict an example of a rotation direction switching mechanism.
Figure 41:
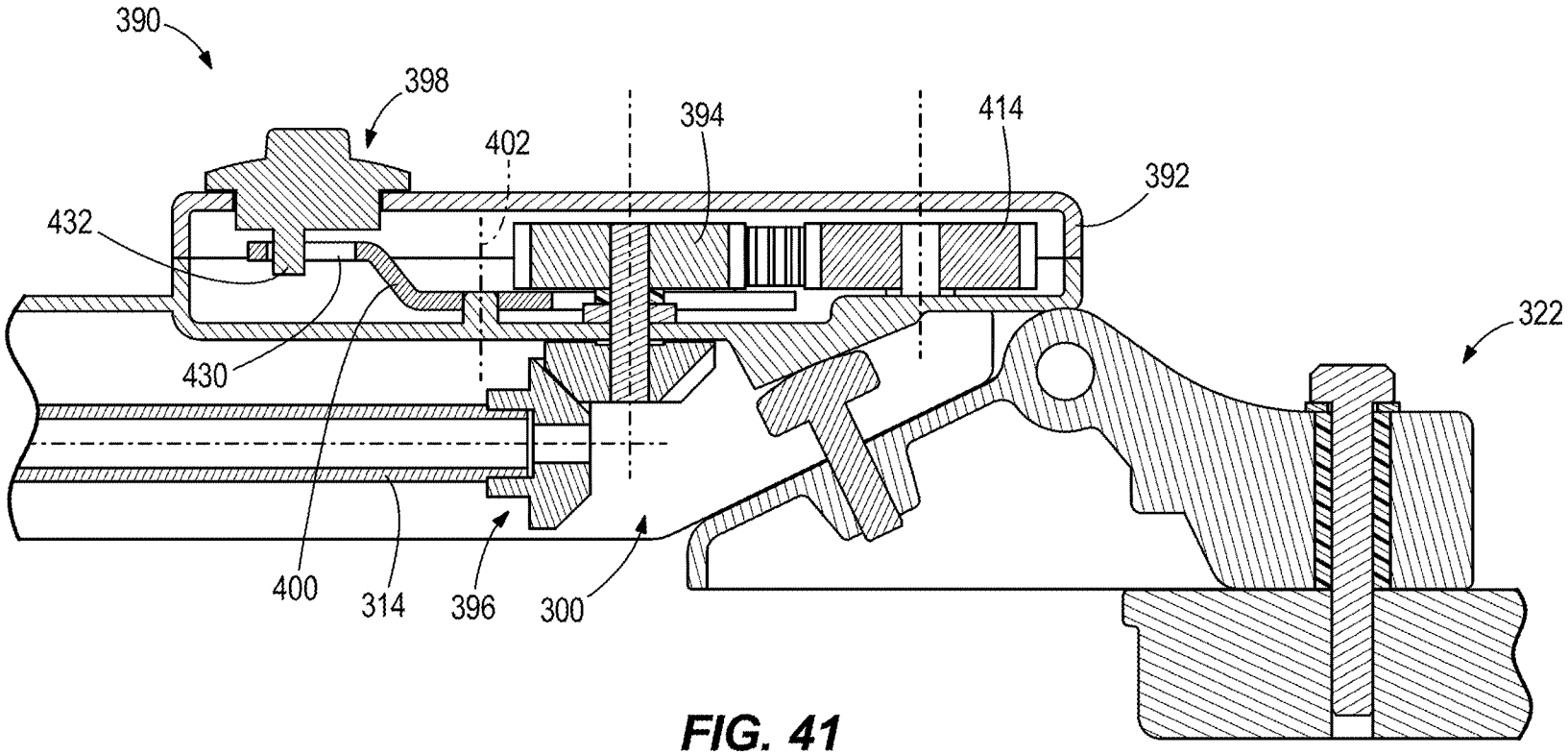
Figure 42:
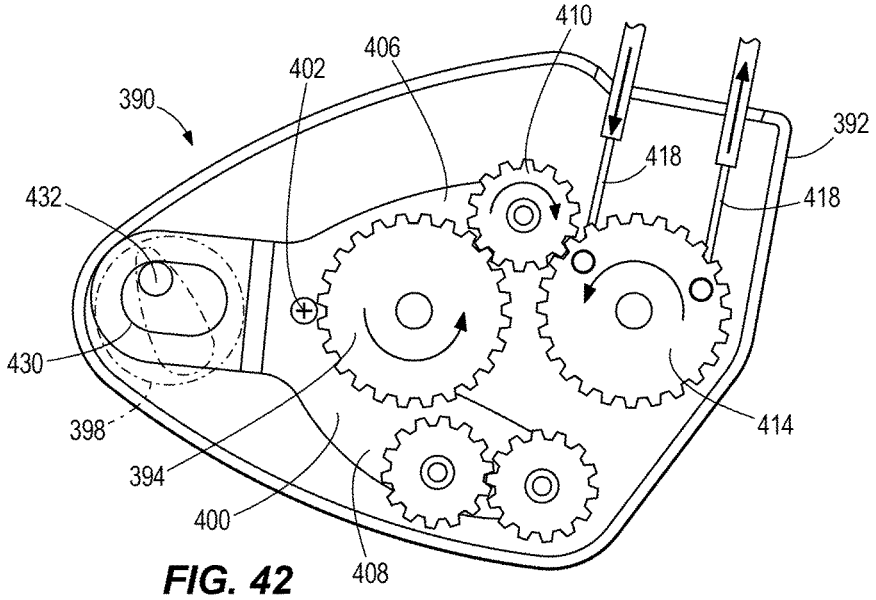
Figure 43:
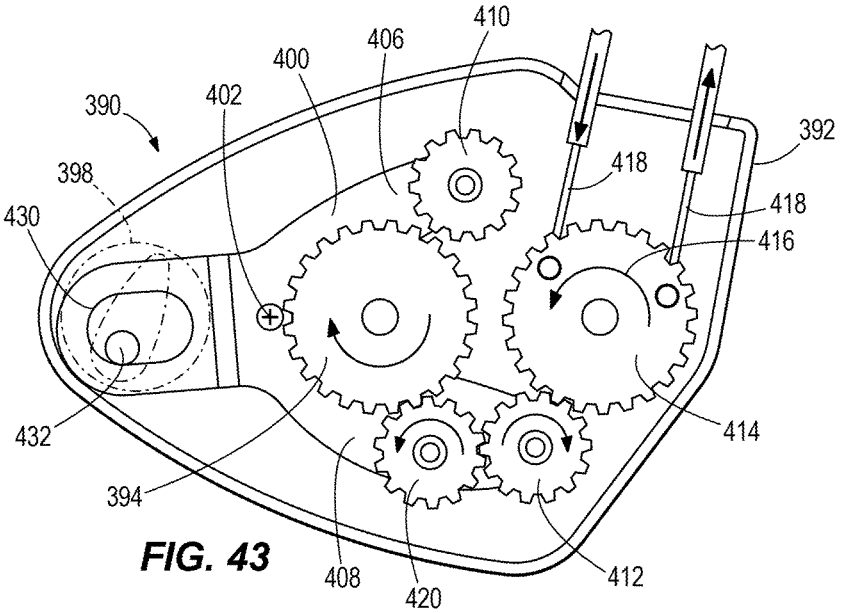

FIGS. 38 and 39 depict an alternate example of a throttle linkage and rotation direction switching mechanism (generally referred to at 369). As shown in FIGS. 38 and 39, the throttle linkage 370 includes a throttle gear 372 having a throttle arm 374. Rotation of the throttle gear 372 about its center axis causes rotation of the throttle arm 374 (as shown at arrow 378). A conventional throttle cable (not shown) is connected to the throttle arm 374 and the corresponding throttle on the outboard motor 12, such that rotation of the throttle arm 374 at arrow 378, increases throttle position. Opposite rotation of the throttle arm 374 decreases throttle position. This type of throttle connection is conventional and thus is not further shown or described herein. A driving gear 380 is disposed on the throttle shaft 314, such that rotation of the throttle shaft 314 causes rotation of the driving gear 380. The driving gear 380 is engaged with the throttle gear 372, such that rotation of the throttle grip 310 causes rotation of the throttle shaft 314, which causes rotation of the driving gear 380, which causes rotation of the throttle gear 372 and throttle arm 374, to thereby control throttle position on the outboard motor 12, as described herein above.

To facilitate switching between left-handed and right-handed operation of the throttle grip 310, the driving gear 380 is positionable into a first position (FIG. 38) wherein the driving gear 380 engages with a first side of the throttle gear 372 so that rotation of the throttle grip 310 through the first left-handed range of motion 344 controls the throttle of the outboard motor 12. Alternately, the driving gear 380 is positionable in a second position (FIG. 39) wherein the driving gear 380 engages with a opposite, second side of the throttle gear 372 so that rotation of the throttle grip 310 through the second range of motion 346 controls the throttle of the outboard motor 12. As shown in FIGS. 38 and 39, the driving gear 380 is positionable along the throttle shaft 314 on the noted first and second sides of the throttle gear 372. The driving gear 380 can be positioned along the throttle shaft 314 by connection of a pin and hole 382. Before use, the operator or more likely a technician can remove the throttle shaft 314 from the tiller body 302 by loosening the mounting sleeve 39 and/or hold-down bracket 41. Then the driving gear 380 can be removed from and repositioned on the throttle shaft 314 via for example a pin connection with a hole 382 on the throttle shaft 314. Then the throttle shaft 314 can be re-secured to the tiller body 302 via the mounting sleeve 39 and hold-down bracket 41 so that the driving gear 380 again engages with the throttle gear 372.

FIGS. 40-43 depict an alternate example of the rotation direction switching mechanism 390. The rotation direction switching mechanism 390 is contained in a housing 392 disposed on the tiller 300. The rotation direction switching mechanism 390 includes a driving gear 394 that is coupled to the throttle shaft 314 by a bevel gear set 396 such that rotation of the throttle shaft 314 causes rotation of the driving gear 394. A manual switch 398 is connected to a switching bracket 400. Rotation of the manual switch 398 about its center axis causes pivoting motion of the switching bracket 400 about a pivot axis 402. The switching bracket 400 has opposing arms 406, 408 that carry first and second connecting gears 410, 412, respectively. A throttle gear 414 is rotatable in one direction (arrow 416) about its own axis and is connected to conventional throttle cables 418. The rotation direction switching mechanism 390 is manually actuated via the manual switch 398 to position the switching bracket 400 in to the positions shown in FIGS. 42 and 43, to thereby alternately connect the first connecting gear 410 and the second connecting gear 412 to the throttle gear 414. A reversing gear 420 couples the driving gear 394 to the second connecting gear 412, to provide corresponding rotation to the throttle gear 414.

To facilitate switching between left-handed and right-handed operation of the throttle grip, the operator manually turns the switch 398 about its center axis, which in turn causes pivoting motion of the switching bracket 400 about the pivot axis 402. The manual switch 398 can be connected to the switching bracket 400 along an inner contour 430 via a post 432 such that an overcenter force is effected, which registers the manual switch 98 with respect to the switching bracket 400 into left-handed or right-handed operation. Rotation of the switching bracket about the pivot axis 402 in a first direction moves the opposing arm 46 towards the throttle gear 14 and moves the opposing arm 408 away from the throttle gear 414. This causes engagement between the first connecting gear 410 and the throttle gear 414 and simultaneously causes disengagement between the second connecting gear 412 and the throttle gear 414. This facilitates operation of the throttle on the outboard motor during rotation of the throttle grip through the range of motion 344. Alternatively, manually switching the switch 398 in the opposite direction causes pivoting motion of the switching bracket 400 about the pivot axis to disengage the first connecting gear 410 from the throttle gear 14 and simultaneously engage the second connecting gear 412 with the throttle gear 414. (See FIG. 43). This facilitates control of the throttle on the outboard motor when the throttle grip is rotated through the range of motion 346. Rotation of the throttle shaft 314 about its own axis causes rotation of the driving gear 394, and commensurate rotation of the respective connecting gear 410, 412. Rotation of the connecting gear 410, 412 causes opposite rotation of the throttle gear 414, which is translated to the throttle cables 418 and thus to the throttle pulley 318 on the throttle of the outboard motor 12, as described hereinabove.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

What is claimed is:

1. A tiller for an outboard motor, the tiller comprising: a tiller body that is elongated along a tiller axis between a fixed end and a free end, and a throttle grip on the free end, wherein the throttle grip is rotatable through a first range of motion from an idle position in which the outboard motor is controlled at idle speed to first wide open throttle position in which the outboard motor is controlled at wide open throttle speed and alternately through a second range of motion from the idle position to a second wide open throttle position in which the outboard motor is controlled at wide open throttle speed.

2. The tiller according to claim 1, wherein the first range of motion is separate and distinct from the second range of motion.

3. The tiller according to claim 1, wherein the first range of motion is oppositely oriented with respect to the second range of motion.

4. The tiller according to claim 1, wherein the idle position is disposed between the first and second ranges of motion, wherein the first range of motion extends in a first rotational direction away from the idle position and wherein the second range of motion extends in an opposite, second rotational direction away from the idle position.

5. The tiller according to claim 1, wherein the tiller is configured to prevent over-rotation of the throttle grip past the first and second wide open throttle positions.

6. The tiller according to claim 5, further comprising a first engagement structure associated with the throttle grip and a second engagement structure associated with the tiller body, wherein over-rotation of the throttle grip past the first wide open throttle position is prevented by engagement between the first engagement structure and the second engagement structure and wherein over-rotation of the throttle grip past the second wide open throttle position is prevented by engagement between the first engagement structure and the second engagement structure.

7. The tiller according to claim 6, wherein the first engagement structure comprises at least one radially inwardly extending ledge on the throttle grip and wherein the second engagement structure comprises at least one radially outwardly extending ledge on the tiller body.

8. The tiller according to claim 6, further comprising a throttle shaft coupled to the throttle grip such that rotation of the throttle grip causes rotation of the throttle shaft, wherein the first engagement structure comprises a radially extending member on the throttle shaft and wherein the second engagement structure comprises a corresponding radially extending member on the tiller body.

9. The tiller according to claim 8, wherein the radially extending member on the tiller body comprises a contour that is configured to receive and retain the radially extending member on the throttle shaft.

10. The tiller according to claim 9, wherein the radially extending member on the tiller body is rotatable into and between a first position in which the contour is oriented to receive the radially extending member on the throttle shaft when the throttle grip is rotated through the first range of motion and a second position in which the contour is oppositely oriented to receive the radially extending member on the throttle shaft when the throttle grip is rotated through the second range of motion.

11. A tiller system for controlling an outboard motor, the tiller system comprising:

a tiller comprising a tiller body that is elongated along a tiller axis between a fixed end and a free end, and a throttle grip on the free end, wherein the throttle grip is rotatable through a first range of motion from an idle position in which the outboard motor is controlled at idle speed to first wide open throttle position in which the outboard motor is controlled at wide open throttle speed and alternately through a second range of motion from the idle position to a second wide open throttle position in which the outboard motor is controlled at wide open throttle speed;

a throttle linkage coupled to the throttle grip, wherein the throttle linkage is configured to control a throttle of the outboard motor based upon manual rotation of the throttle grip; and a rotation direction switching mechanism that is movable into a first position in which movement of the throttle grip in the first range of motion causes the throttle linkage to control the throttle of the outboard motor and a second position in which movement of the throttle grip in the second range of motion causes the throttle linkage to control the throttle of the outboard motor.

12. The tiller system according to claim 11, wherein the throttle linkage comprises a throttle shaft coupled to the throttle grip such that rotation of the throttle grip causes rotation of the throttle shaft; wherein the rotation direction switching mechanism comprises a pulley on the throttle shaft, a pulley on the throttle of the outboard motor, and a pair of cables that connect the pulley on the throttle shaft to the pulley on the throttle of the outboard motor so that rotation of the throttle grip causes rotation of the pulley on the throttle of the outboard motor; and wherein the pulley cables are positionable in a first position in which rotation of the throttle grip through the first range of motion causes rotation of the pulley on the throttle of the outboard motor and a second position in which rotation of the throttle grip through the second range of motion causes rotation of the pulley on the throttle of the outboard motor.

13. The tiller system according to claim 11, wherein the throttle linkage comprises a throttle shaft coupled to the throttle grip such that rotation of the throttle grip causes rotation of the throttle shaft; wherein the rotation direction switching mechanism comprises a driving gear that rotates with the throttle shaft and a throttle gear that is rotated by the driving gear; and wherein the rotation direction switching mechanism is positionable in a first position in which the driving gear drives the throttle shaft gear so that rotation of the throttle grip through the first range of motion controls the throttle of the outboard motor and a second position in which the driving gear drives the throttle gear so that rotation of the throttle grip through the second range of motion controls the throttle of the outboard motor.

14. The tiller according to claim 13, wherein the throttle linkage comprises a throttle shaft and wherein the driving gear is positionable along the throttle shaft on a first side of the throttle gear and alternately along the throttle shaft on an opposite, second side of the throttle gear.

15. The tiller according to claim 14, wherein the tiller shaft has holes located for engagement with a pin to secure the driving gear to the driving shaft on opposite sides of the throttle gear.

16. The tiller system according to claim 11, wherein the rotation direction switching mechanism comprises a driving gear, a first connecting gear, a second connecting gear, and a throttle gear; wherein the driving gear is coupled to the throttle gear by the first connecting gear when a manual switch is moved into the first position; wherein the driving gear is coupled to the throttle gear by the second connecting gear when the manual switch is moved into the second position; and wherein the rotation direction switching mechanism further comprises a reversing gear that rotationally couples one of the first and second connecting gears to the throttle gear.

17. A method of controlling an outboard motor with a tiller, the method comprising:

providing a tiller comprising a tiller body that is elongated along a tiller axis between a fixed end and a free end, and a throttle grip on the free end, wherein the throttle grip is rotatable through a first range of motion from an idle position in which the outboard motor is controlled at idle speed to a first wide open throttle position in which the outboard motor is controlled at wide open throttle speed and alternately through a second range of motion from the idle position to a second wide open throttle position in which the outboard motor is controlled at wide open throttle speed;

providing a throttle linkage coupled to the throttle grip, wherein the throttle linkage is configured to control a throttle of the outboard motor based upon manual rotation of the throttle handle; and switching a rotation direction switching mechanism between a first position in which movement of the throttle grip in the first range of motion controls the throttle of the outboard motor and a second position in which movement of the throttle grip in the second range of motion controls the throttle of the outboard motor.

18. The method according to claim 17, wherein the throttle linkage comprises a throttle shaft coupled to the throttle grip such that rotation of the throttle grip causes rotation of the throttle shaft; wherein the rotation direction switching mechanism comprises a pulley on the throttle shaft, a pulley on the throttle of the outboard motor and a pair of cables that connect the pulley on the throttle shaft to the pulley on the throttle of the outboard motor so that rotation of the throttle grip causes rotation of the pulley on the throttle of the outboard motor; and wherein the pulley cables are positionable in a first position in which rotation of the throttle grip through the first range of motion causes rotation of the pulley on the throttle of the outboard motor and a second position in which rotation of the throttle grip through the second range of motion causes rotation of the pulley on the throttle of the outboard motor; the method comprising:

switching a connection point of one end of the pair of cables to thereby switch the pulley cables from one of the first position and second position to the other of the first position and second position.

19. The method according to claim 17, wherein the throttle linkage comprises a throttle shaft coupled to the throttle grip such that rotation of the throttle grip causes rotation of the throttle shaft; wherein the rotation direction switching mechanism comprises a driving gear that rotates with the throttle shaft and a throttle gear that is rotated by the driving gear; and wherein the rotation direction switching mechanism is positionable in a first position in which the driving gear drives the throttle shaft gear so that rotation of the throttle grip through the first range of motion controls the throttle of the outboard motor and a second position in which the driving gear drives the throttle gear so that rotation of the throttle grip through the second range of motion controls the throttle of the outboard motor; the method comprising:

switching the rotation direction switching mechanism from one of the first position and second position to the other of the first position and second position.

20. The method according to claim 17, wherein the rotation direction switching mechanism comprises a driving gear, a first connecting gear, a second connecting gear, and a throttle gear; wherein the driving gear is coupled to the throttle gear by the first connecting gear when the manual switch is moved into the first position; wherein the driving gear is coupled to the throttle gear by the second connecting gear when the manual switch is moved into the second position; and wherein the rotation direction switching mechanism further comprises a reversing gear that rotationally couples one of the first and second gears to the throttle gear; the method comprising:

switching the rotation direction mechanism from one of the first position and second position to the other of the first position and second position.

* * * * *